US008616096B2

(12) United States Patent
Brown

(10) Patent No.: US 8,616,096 B2
(45) Date of Patent: Dec. 31, 2013

(54) HAND TOOL WITH TORQUE DRIVE SHAFT

(75) Inventor: Daniel P. Brown, Palos Park, IL (US)

(73) Assignee: Loggerhead Tools LLC, Palos Park, IL (US)

( * ) Notice: Subject to any disclaimer, the term of this patent is extended or adjusted under 35 U.S.C. 154(b) by 580 days.

(21) Appl. No.: 12/599,172

(22) PCT Filed: May 2, 2008

(86) PCT No.: PCT/US2008/062379

§ 371 (c)(1),
(2), (4) Date: Nov. 6, 2009

(87) PCT Pub. No.: WO2008/137653

PCT Pub. Date: Nov. 13, 2008

(65) Prior Publication Data

US 2010/0242688 A1 Sep. 30, 2010

Related U.S. Application Data

(63) Continuation of application No. 11/745,345, filed on May 7, 2007, now abandoned, which is a continuation-in-part of application No. 11/669,031, filed on Jan. 30, 2007, now abandoned.

(51) Int. Cl.
*B25B 23/16* (2006.01)
*B25G 1/08* (2006.01)

(52) U.S. Cl.
USPC ..... 81/439; 81/177.6; 81/177.4; 81/58.3

(58) Field of Classification Search
USPC ..... 81/436–439, 429, 64, 177.4, 490, 81/177.2, 28, 177.6, 442, 450, 58.3
See application file for complete search history.

(56) References Cited

U.S. PATENT DOCUMENTS

| | | | |
|---|---|---|---|
| 981,278 | A | 1/1911 | Jenks |
| 1,407,652 | A | 2/1922 | Hallvarson |
| 1,816,812 | A | 9/1930 | Allison |

(Continued)

FOREIGN PATENT DOCUMENTS

| | | |
|---|---|---|
| FR | 2 536 689 | 6/1984 |
| FR | 2 831 088 | 4/2003 |
| GB | 2 137 545 | 10/1984 |
| WO | WO 2008/137653 A2 | 11/2008 |

OTHER PUBLICATIONS

European Patent Office, Supplementary Search Report of EP 08 74 7473, Sep. 20, 2010, The Hague.

(Continued)

*Primary Examiner* — Hadi Shakeri
(74) *Attorney, Agent, or Firm* — Vedder Price P.C.

(57) ABSTRACT

The present disclosure relates to a hand-held tool that may be held in the palm of a hand, the hand-held tool being of adequate length and size to allow users to comfortably transfer the tool from a palm grip to a pen grip to maintain the use of the fingers and the thumb when the hand tool is stored in the palm. The hand tool is also equipped with a retractable or nonretractable torque drive shaft designed to allow the fingers and thumb of a user to be rotated freely when the tool is in palm grip and capable of transmitting torque through the housing when an axial pressure force is placed along the drive shaft to engage the tool head with the housing.

19 Claims, 30 Drawing Sheets

(56) References Cited

U.S. PATENT DOCUMENTS

| | | | | |
|---|---|---|---|---|
| 2,443,339 | A | 8/1944 | Blalock | |
| D168,900 | S | 2/1953 | Lutsker | |
| 2,651,840 | A | 9/1953 | Taylor | |
| 2,804,970 | A | 9/1957 | Kue et al. | |
| 3,799,226 | A | 3/1974 | Lavietes | |
| 3,824,881 | A | 7/1974 | Wright | |
| 3,827,470 | A * | 8/1974 | Douglas et al. | 81/58.3 |
| 3,863,693 | A | 2/1975 | Carriker | |
| 4,210,185 | A | 7/1980 | Acevedo | |
| 4,235,133 | A | 11/1980 | Acevedo | |
| 4,235,269 | A | 11/1980 | Kraus | |
| 4,241,773 | A | 12/1980 | Personnat | |
| 4,341,292 | A | 7/1982 | Acevedo | |
| 4,434,828 | A | 3/1984 | Trincia | |
| 4,440,048 | A | 4/1984 | Stevens et al. | |
| 4,512,693 | A | 4/1985 | Swanson | |
| 4,546,677 | A | 10/1985 | Berkich | |
| 4,606,246 | A | 8/1986 | Gunther | |
| 4,779,493 | A | 10/1988 | White | |
| 4,799,407 | A | 1/1989 | Miyamoto | |
| 4,848,197 | A | 7/1989 | Kikel | |
| 4,934,223 | A | 6/1990 | Wong | |
| 4,945,639 | A | 8/1990 | Kirby | |
| 5,211,086 | A * | 5/1993 | Shu | 81/58.3 |
| 5,280,659 | A | 1/1994 | Park | |
| 5,427,003 | A | 6/1995 | Boltak et al. | |
| 5,437,212 | A | 8/1995 | Thompson et al. | |
| 5,450,774 | A | 9/1995 | Chang | |
| 5,499,562 | A | 3/1996 | Feng | |
| 5,512,165 | A | 4/1996 | Liu | |
| 5,517,885 | A | 5/1996 | Feng | |
| 5,522,291 | A | 6/1996 | Liu | |
| 5,535,882 | A | 7/1996 | Liu | |
| 5,570,616 | A | 11/1996 | Thompson et al. | |
| 5,600,914 | A | 2/1997 | Tatar | |
| D385,172 | S | 10/1997 | Bramsiepe et al. | |
| 5,711,042 | A | 1/1998 | Chuang | |
| 5,711,194 | A | 1/1998 | Anderson et al. | |
| 5,735,005 | A | 4/1998 | Wang | |
| 5,802,936 | A | 9/1998 | Liu | |
| 5,809,600 | A | 9/1998 | Cachot | |
| 5,836,223 | A | 11/1998 | Lin | |
| 5,887,306 | A | 3/1999 | Huang | |
| 5,894,765 | A | 4/1999 | Anderson et al. | |
| 5,918,513 | A | 7/1999 | Ho | |
| 5,927,162 | A | 7/1999 | Huang | |
| 5,927,164 | A | 7/1999 | Anderson et al. | |
| 5,964,132 | A | 10/1999 | Chen | |
| 5,970,553 | A | 10/1999 | Lin | |
| 5,970,828 | A | 10/1999 | Bondhus et al. | |
| 6,023,805 | A | 2/2000 | Lin | |
| 6,047,619 | A | 4/2000 | Anderson et al. | |
| 6,082,232 | A | 7/2000 | Anderson et al. | |
| 6,101,654 | A | 8/2000 | Cachot | |
| 6,109,148 | A | 8/2000 | Anderson et al. | |
| 6,119,561 | A | 9/2000 | Anderson et al. | |
| 6,131,222 | A | 10/2000 | Anderson et al. | |
| 6,151,999 | A | 11/2000 | Eklind | |
| D435,415 | S | 12/2000 | Johnson et al. | |
| 6,196,093 | B1 | 3/2001 | Hu | |
| D440,141 | S | 4/2001 | Yeh | |
| 6,260,445 | B1 | 7/2001 | DeVecchis et al. | |
| 6,260,453 | B1 | 7/2001 | Anderson et al. | |
| 6,286,397 | B1 | 9/2001 | Taggart et al. | |
| 6,341,423 | B1 | 1/2002 | Taggart et al. | |
| 6,352,010 | B1 | 3/2002 | Giarritta et al. | |
| 6,378,407 | B1 | 4/2002 | Purkapile | |
| 6,397,709 | B1 | 6/2002 | Wall | |
| 6,405,865 | B1 | 6/2002 | Lin | |
| 6,431,034 | B1 | 8/2002 | Chen | |
| 6,622,597 | B2 | 9/2003 | Chen | |
| 6,640,675 | B1 | 11/2003 | Chuang | |
| 6,732,613 | B2 | 5/2004 | Hsieh | |
| 6,739,224 | B1 | 5/2004 | Wershe | |
| 6,845,694 | B2 | 1/2005 | Ping | |
| 6,877,186 | B2 | 4/2005 | Shiao | |
| 6,880,435 | B2 | 4/2005 | Hawkins | |
| 6,957,492 | B1 | 10/2005 | Westfall | |
| D515,391 | S | 2/2006 | Hawkins | |
| 7,013,765 | B2 | 3/2006 | Chang | |
| 7,032,483 | B2 | 4/2006 | Liu | |
| 7,039,975 | B1 | 5/2006 | Liao | |
| 7,051,629 | B2 | 5/2006 | Huang | |
| D523,634 | S | 6/2006 | Dost et al. | |
| 7,055,410 | B2 | 6/2006 | Hu | |
| 7,066,061 | B1 | 6/2006 | Chen et al. | |
| 7,739,930 | B2 * | 6/2010 | Schunke | 81/177.4 |
| 2003/0079580 | A1 | 5/2003 | Beauchamp | |
| 2003/0196273 | A1 | 10/2003 | Anderson et al. | |
| 2005/0284267 | A1 | 12/2005 | Liao | |
| 2006/0048610 | A1 | 3/2006 | Hu | |
| 2006/0162508 | A1 | 7/2006 | Liu | |
| 2006/0225537 | A1 | 10/2006 | Shiao | |

OTHER PUBLICATIONS

International Search Report corresponding to International Application No. PCT/US2008/062379, U.S. Patent Office, dated Oct. 2, 2008, 3 pages.

* cited by examiner

HAND TOOL WITH TORQUE DRIVE SHAFT

RELATED APPLICATIONS

This application is a 371 National Stage Entry of International Application No. PCT/US2008/062379, filed May 2, 2008, which claims the benefit of and priority from U.S. patent application Ser. No. 11/745,345, filed May 7, 2007, which is a continuation-in-part which claims the benefit and priority of U.S. patent application Ser. No. 11/669,031, filed Jan. 30, 2007, which are expressly incorporated herein by reference.

FIELD OF THE DISCLOSURE

The present disclosure relates to a hand tool with a torque drive shaft and a housing equipped to house multiple work pieces, and more particularly, to a hand tool with a drive shaft in a freewheeling position capable of torque when an axial pressure force is placed along the drive shaft, and capable of manual removal from the housing for use of the drive shaft as a tool.

BACKGROUND

Hand tools are used to assemble, repair, service, or build different mechanical equipment. Tools are used in the home and workshop for a wide range of applications, including the assembly of furniture, repairing a ventilation grate, fixing a door or window, etc. Tools are also used in commercial settings by service providers, including installing cable service, repairing a vehicle, working in a shop, etc. Hand tools such as screwdrivers, wrenches, hammers, and crowbars are designed for manual use by an individual and must have a controlled weight and size that allow repetitive use without undue fatigue. Hand tools are used to deliver targeted forces such as blunt forces, torques, and punctures upon different materials. For example, a screwdriver must transfer a torque created from the wrist of an individual onto a screw that must be removed or inserted.

Efficient hand tools allow for targeted use of manual force upon a point of use to limit muscle fatigue of a user. One way to limit muscle fatigue is by reducing the weight of the hand tool, often making the tool more brittle and prone to damage. Another way to limit fatigue is to better anticipate and optimize the multiple steps needed to perform a task. When inserted or removed, screws need a high degree of torque but low rotational movement at positions where the screw is gripped, stuck, or must deform the greatest amount of matter to push in. Screws also need low torque but high rotational movement at a position where the screw moves almost freely along filets. A user ends up wasting valuable time and energy by moving the totality of a conventional tool during removal of a screw when such movement is not truly required. What is needed is a hand tool capable of transfering high torque when needed but also low torque without having to move the weight of the hand tool.

Another known problem with hand tools is their incapacity to utilize the human hand in which they are placed. The human hand has a metacarpus (a broad inside palm) attached to the carpus (the wrist) capable of delivering strong torque to hand tools placed within the curve of a hand. The hand is also equipped with four fingers placed in opposition via the trapedium to a thumb capable of very high tactile dexterity and perform precise actions using a hand tool placed in proximity with the ends of the fingers and thumb. Currently, hand tools fail to utilize the combination of force of the bottom section of the hand and the dexterity of the upper section of the hand when conducting a single operation. For example, screwdriver users hold a tool in their palm and must transfer the hand tool out of the hand to use the tip of the fingers to feel the precision of the screw position on a surface during the final stages of insertion. What is needed is a hand tool capable of utilizing the unique capacity of the finger tips and the thumb while at the same time utilizing the strength of the palm of a hand.

Tool users may also work remotely from a ledge or a flat surface where tools can be put down between successive uses. Some tool users equip themselves with toolbelts or wrist bands to store the tool between uses. Again, energy is lost by having to remove the hand tool from the hand and having to place it back the the hand when needed. The adult human hand is capable of numerous types of grips. Dentists and surgeons, for example, distinguish among the different types of grips. The adult human hand is dextrous enough to transfer a hand tool used in a pen grasp (between the tips of the fingers) to a palm grasp (between the palm and the bottom of the small finger) and so forth without the need of a second hand. A hand tool capable of being handled with a finger grip and a palm grip should also be capable of temporary storage within the hand while a user requires the use of his four fingers and thumb. What is needed is a hand tool capable of utilizing this unique capacity of the adult human in conjunction with the other advantages given above to save energy by reducing the displacements required to operate a hand tool.

SUMMARY

The present disclosure relates to a hand-held tool that may be held in the palm of a hand, the hand-held tool being of adequate length and size to allow users to comfortably transfer the tool from a palm grip to a pen grip to maintain the use of the fingers and the thumb when the hand tool is stored in the palm. One or several storage housings are attached offset from a drive shaft housing for improved torque transfer from a hand to the tool head, integral storage of work pieces, optimized use of palm torque during use, and better overall grasping. The hand tool is also equipped with a retractable or nonretractable torque drive shaft designed to allow the fingers and thumb of a user to be rotated freely when the tool is in palm grip and capable of transmitting torque through the housing when an axial pressure force is placed along the drive shaft to engage the tool head with the housing. The drive shaft can also be reversed to create a prolongation shaft or placed in another opening of the housing. In yet another embodiment, a flexible shaft or a telescopic shaft can be used as a drive shaft to reach remote or offset locations. In another embodiment, a biasing element can be used as a grip to activate the drive shaft. In another embodiment, the drive shaft can be dissociated from the housing and used independently. In another embodiment, the drive shaft can be forced into a torque drive mode by locking the drive shaft into the housing or a holster while the hand tool is used. Finally, a coupler is used to alternate between a freewheeling position and a coupled position.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION

Figure 1:
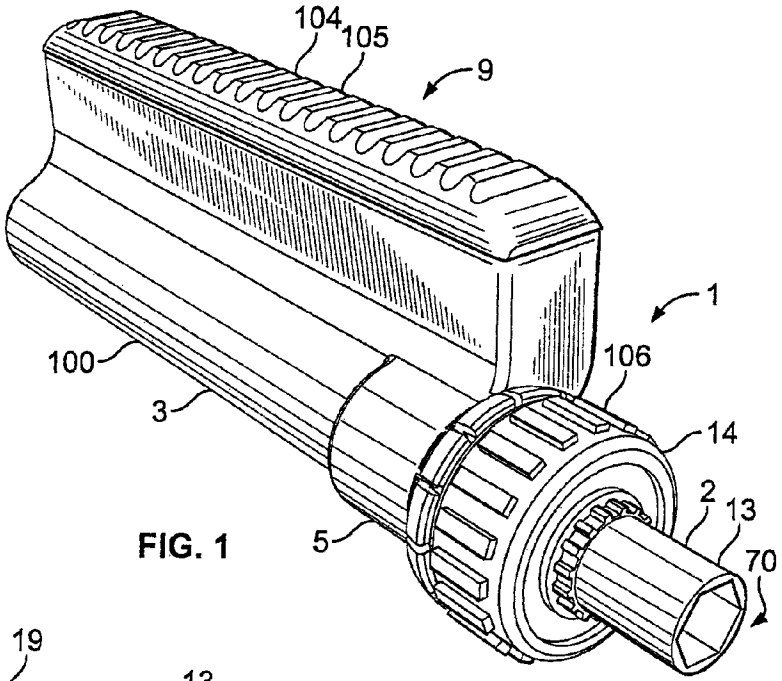
FIG. 1 is a perspective view of the hand tool with torque drive shaft where the biasing force made by the housing according to a first embodiment of the present disclosure.

FIGS. 1-41 illustrate eight of the numerous possible embodiments of hand tool 1 shown in this disclosure when the teachings taught hereafter are embodied in a handful of embodiments. For each of the disclosed embodiments, what is contemplated is the use of a drive assembly 2 having a drive shaft 13 capable of rotation and insertion on an opposing end or at a different location in a housing 3. FIGS. 1-13 show a hand tool 1 with a torque drive shaft, also known as a drive assembly 2, with a housing 3 with a first type of actuator 14 that slides into the housing 3 from a second engaged operating position shown in FIG. 5 to a first disengaged operating position shown in FIG. 4. The drive assembly 2 is biased outwards from the housing 2 to a freewheeling mode associated with the first operating position by a biasing force made by the housing upon the actuator 14.

Figure 16:
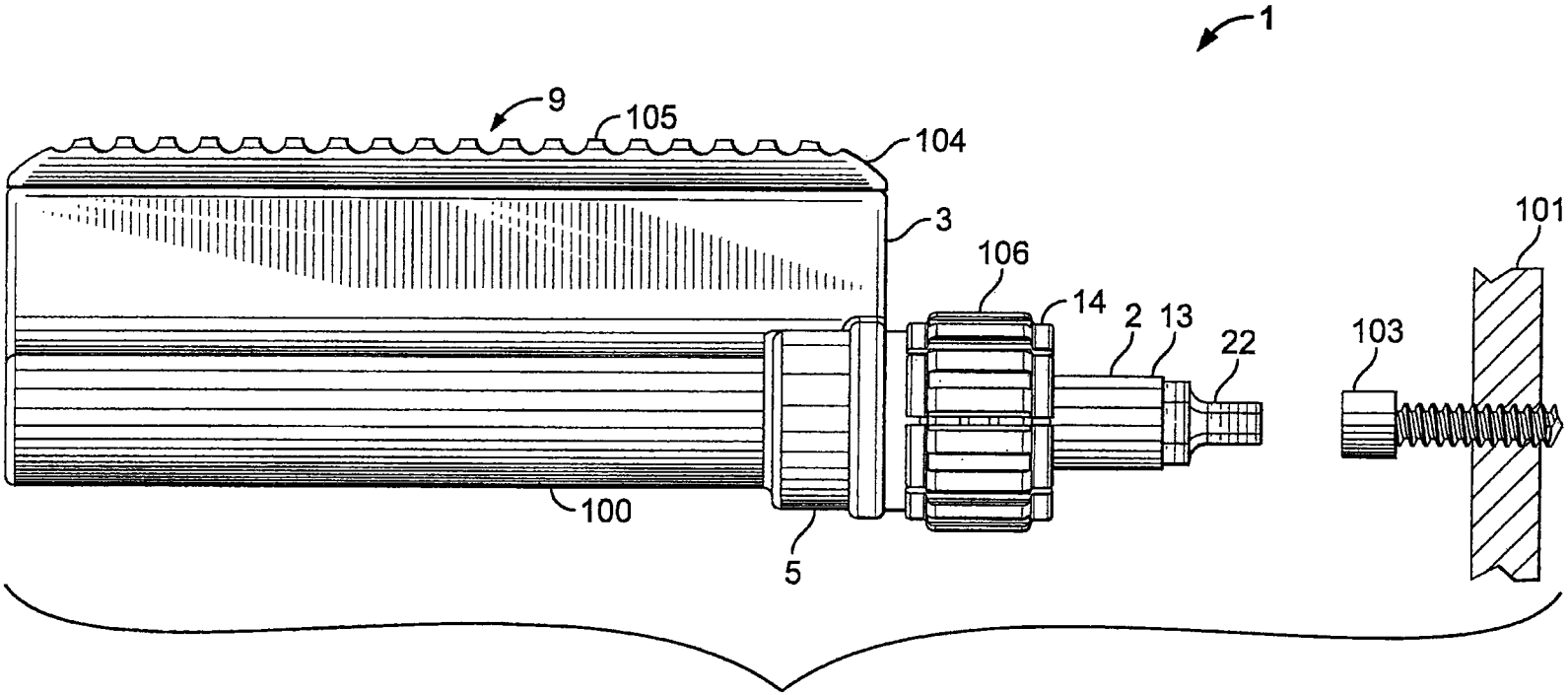
FIG. 16 is a side elevation view of the hand tool of FIG. 14 with a work piece in alignment to impart work to a work piece.
Figure 17:
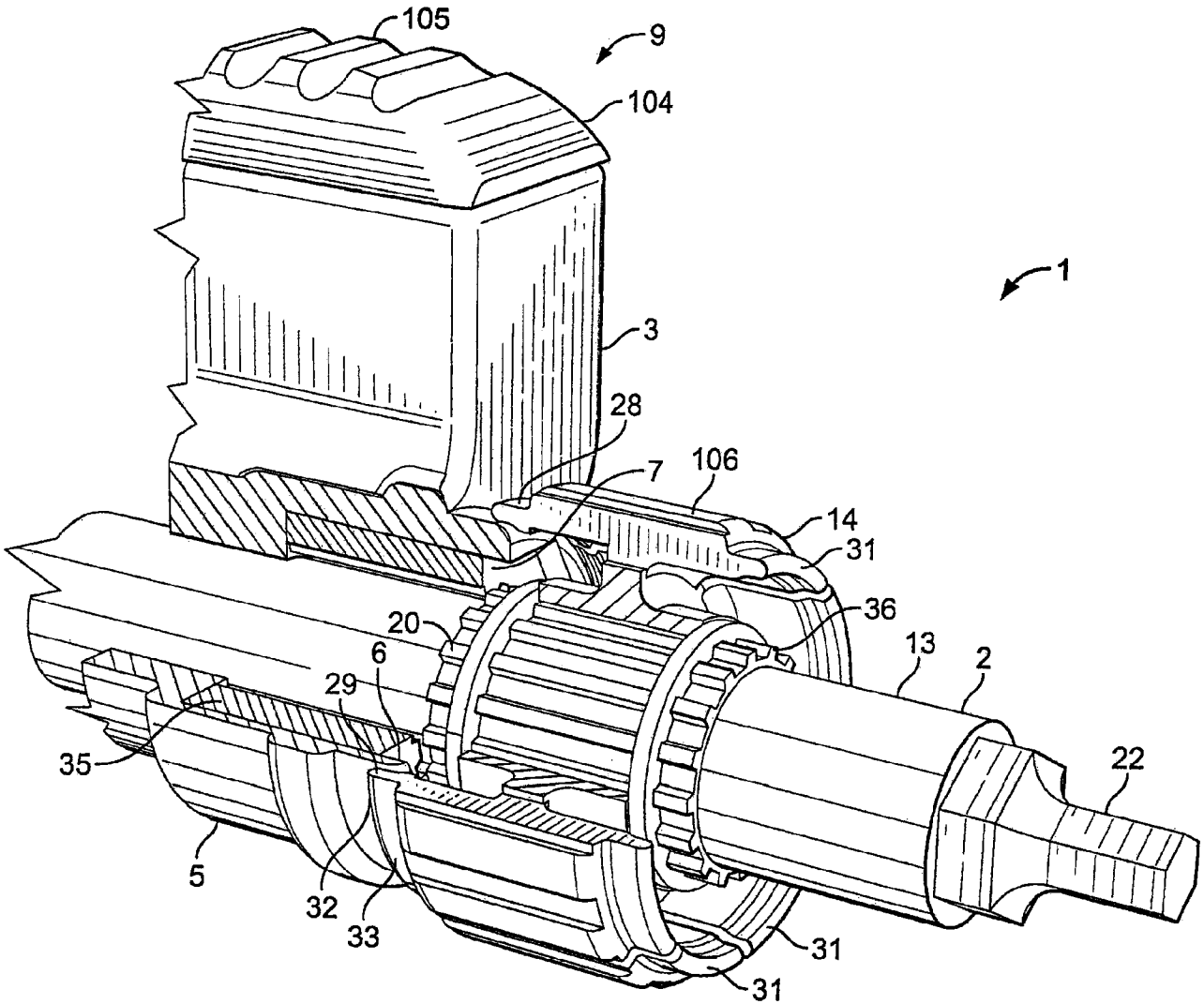
FIG. 17 is a detailed cut-away view of the hand tool of FIG. 14 in a first operating position.
Figure 18:
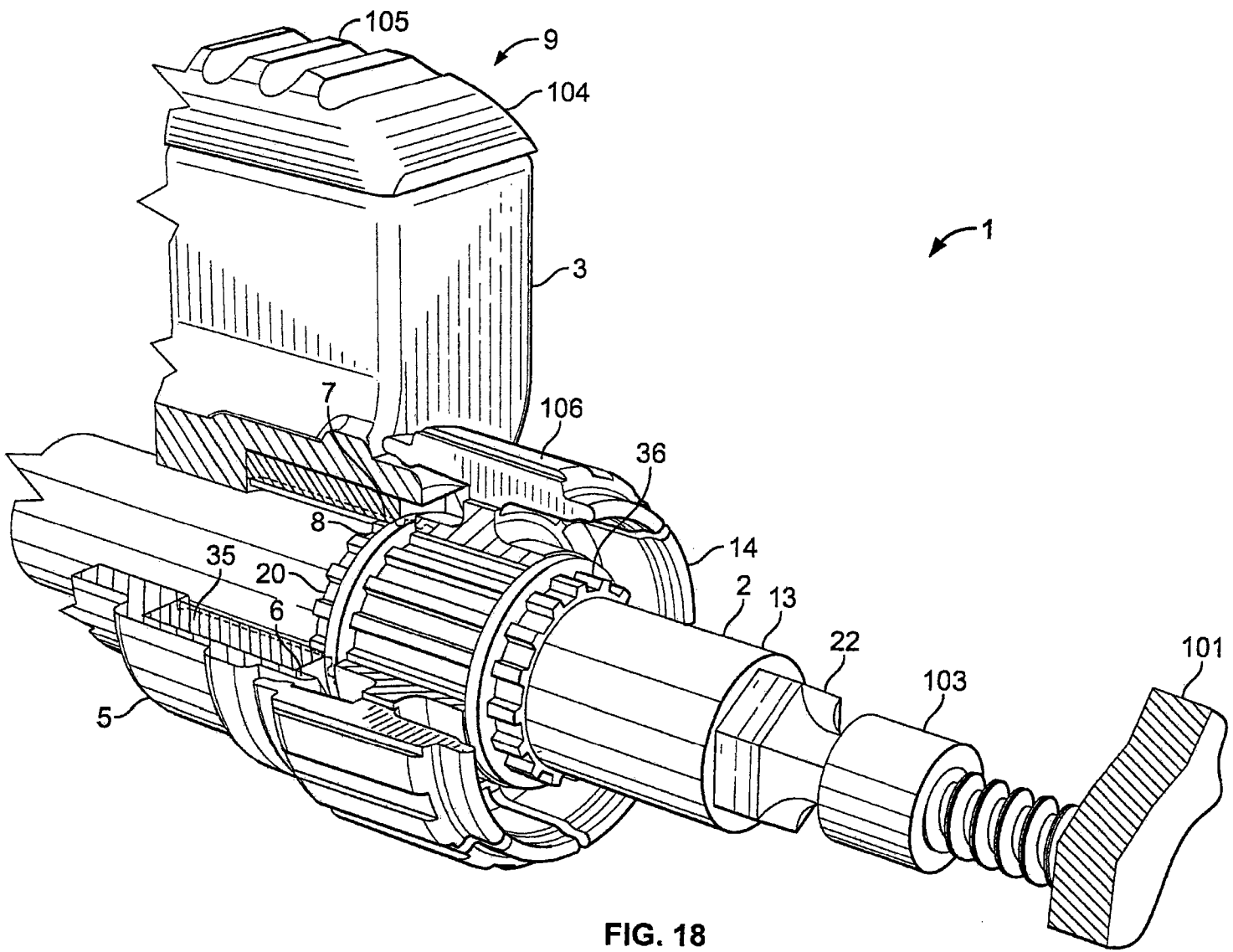
FIG. 18 is a detailed cut-away view of the hand tool of FIG. 14 in a second operating position.

FIGS. 14-18 show another embodiment of the hand tool 1 according to a second embodiment where the actuator 14 slides over part of the housing 3 to move the drive assembly 2 from a second engaged operating position shown in FIG. 18 to a first disengaged operating position shown in FIG. 17. The drive assembly 2 is biased outward from the housing 3 to a freewheeling mode associated with the first operating position by a biasing force made by the actuator 14 upon the housing 3.

Figure 22:
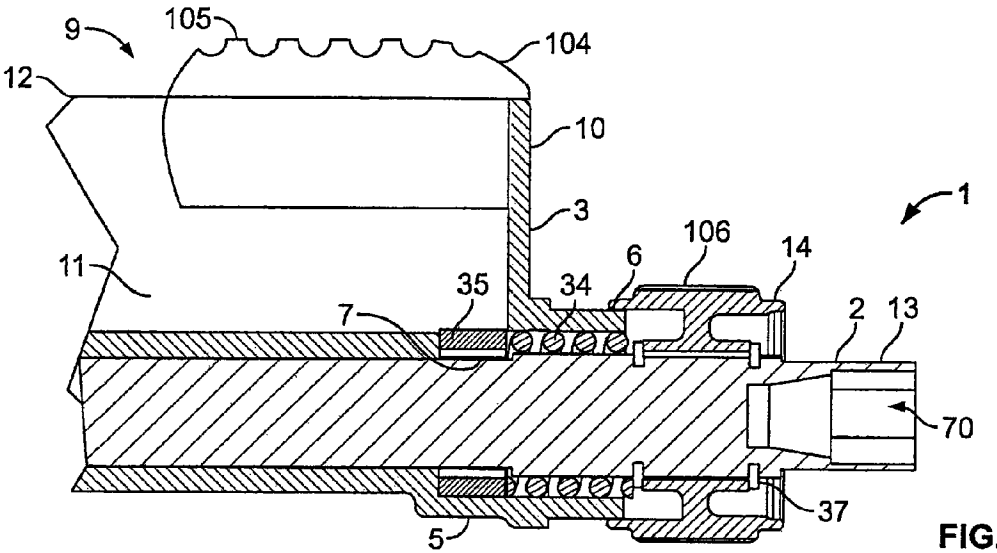
FIG. 22 is a partial cross-sectional view of the hand tool of FIG. 19 in a first operative position.
Figure 23:
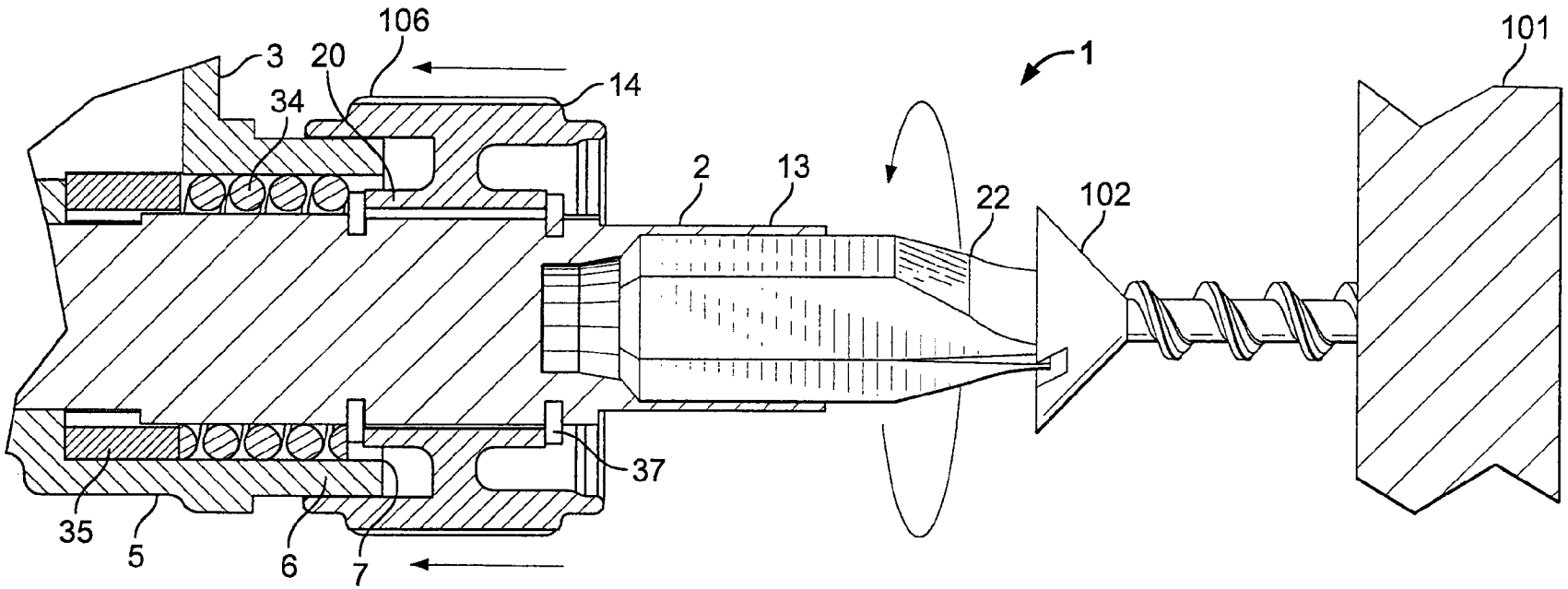
FIG. 23 is detailed partial cross-sectional view of the hand tool of FIG. 19 in a second operative position.

FIGS. 19-23 show another embodiment of the hand tool 1 according to a third embodiment where the actuator 14 slides over directly against the housing 3 to move the drive assembly 2 from a second engaged operating position shown in FIG. 23 to a first disengaged operating position shown in FIG. 22. The drive assembly 2 is biased outward from the housing 2 to a freewheeling mode associated with the first operating position by a biasing force made by a spring 34 acting against the actuator 14 and the housing 3.

Figure 24:
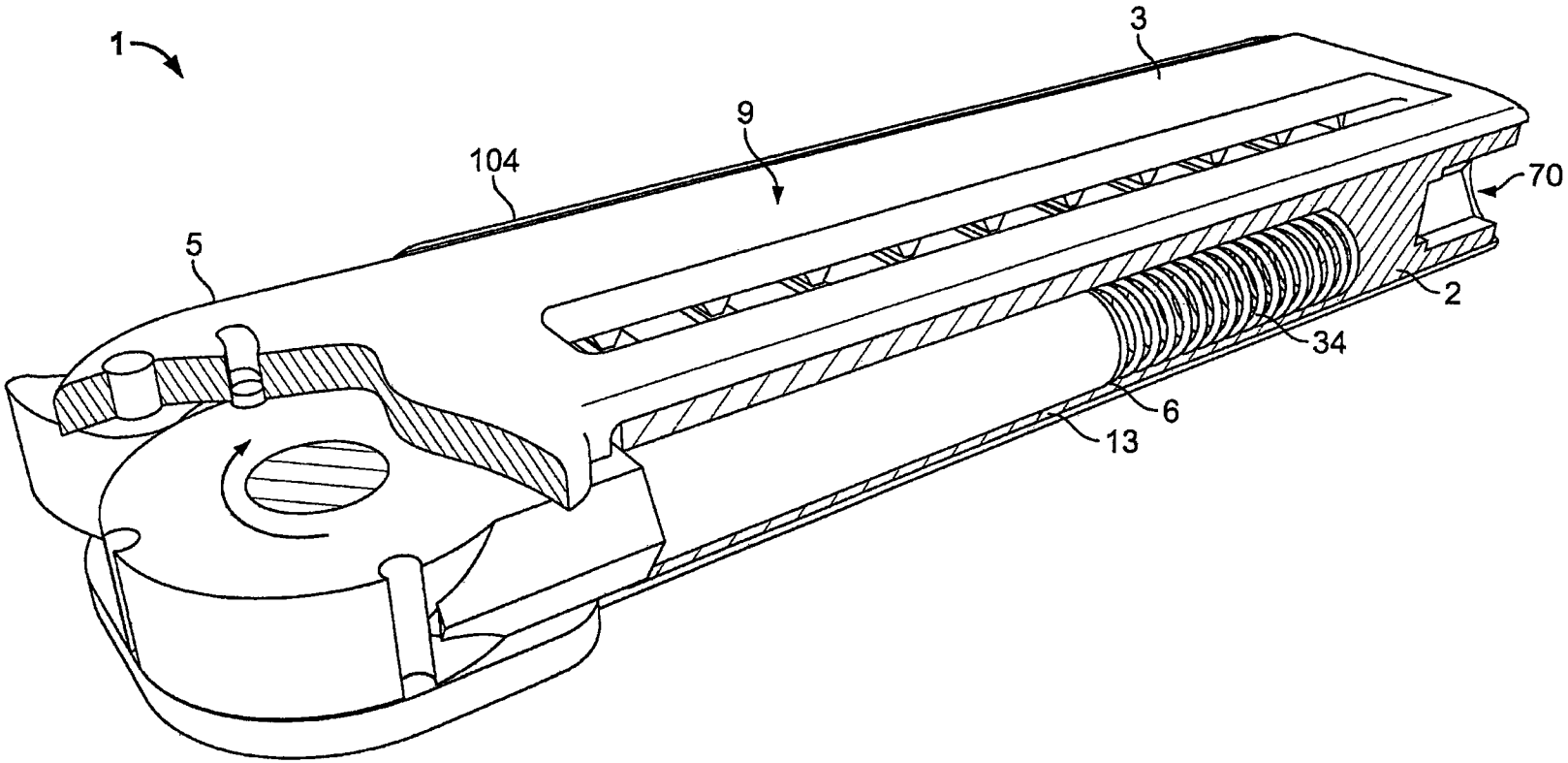
FIG. 24 is a detailed cut-away view of the hand tool with torque drive shaft with pivoting head in closed configuration according to another embodiment of the present disclosure.
Figure 25:
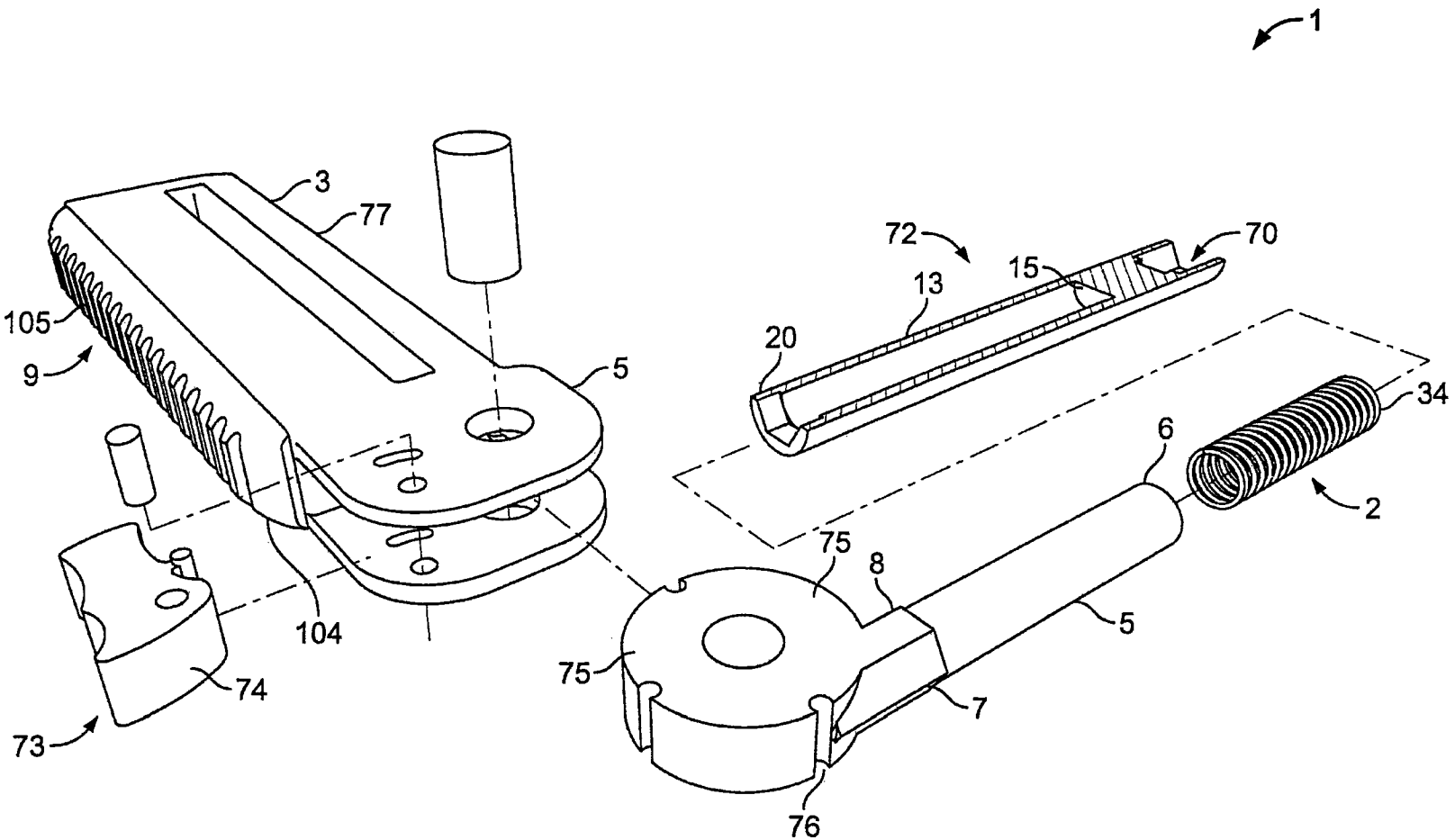
FIG. 25 is an exploded perspective view of the hand tool of FIG. 24 with the torque drive shaft pivoted at a 90° angle in a semi-opened configuration.
Figure 26:
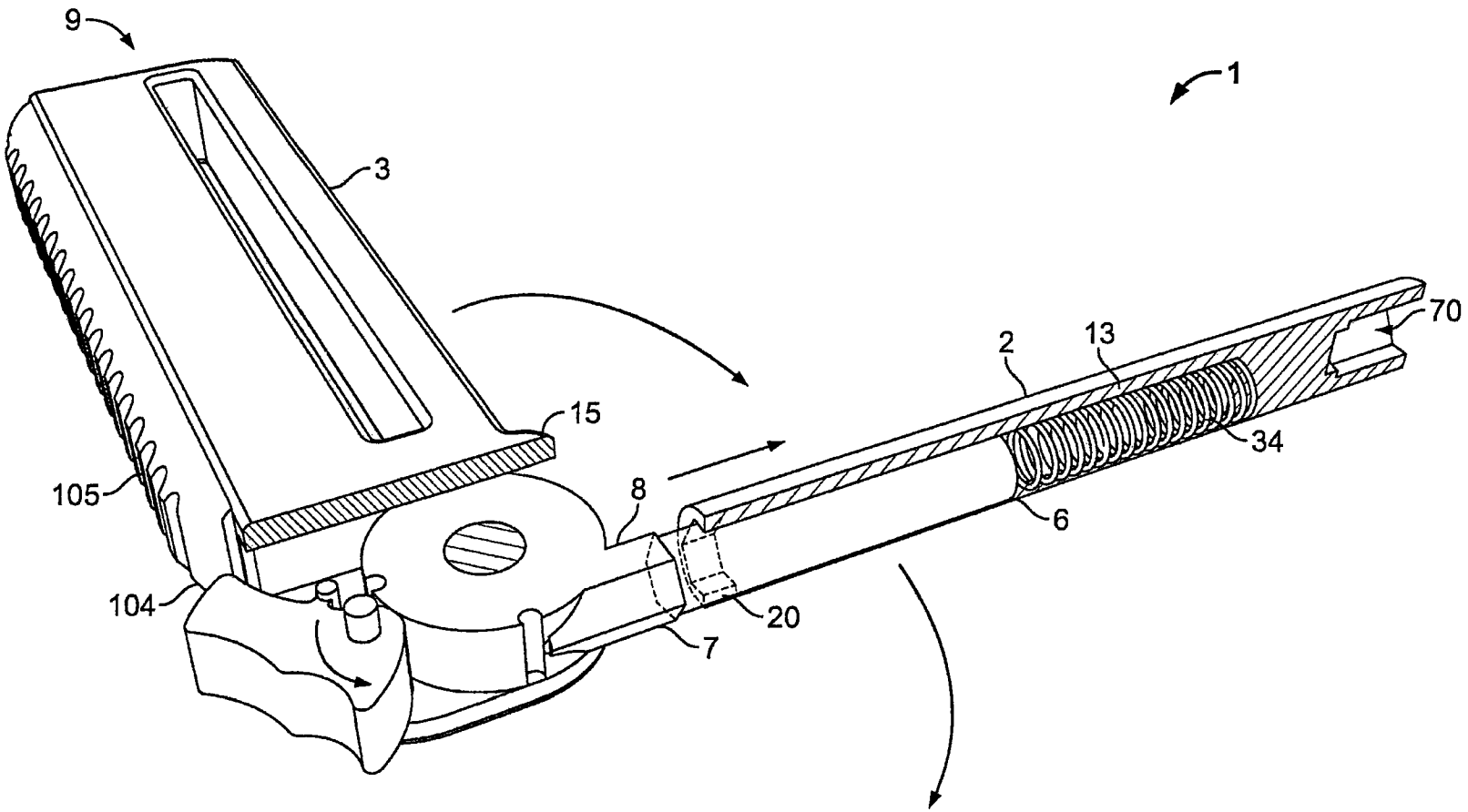
FIG. 26 is a partial cut-away view of the hand tool of FIG. 24 in the semi-opened configuration in a first operative position.
Figure 27:
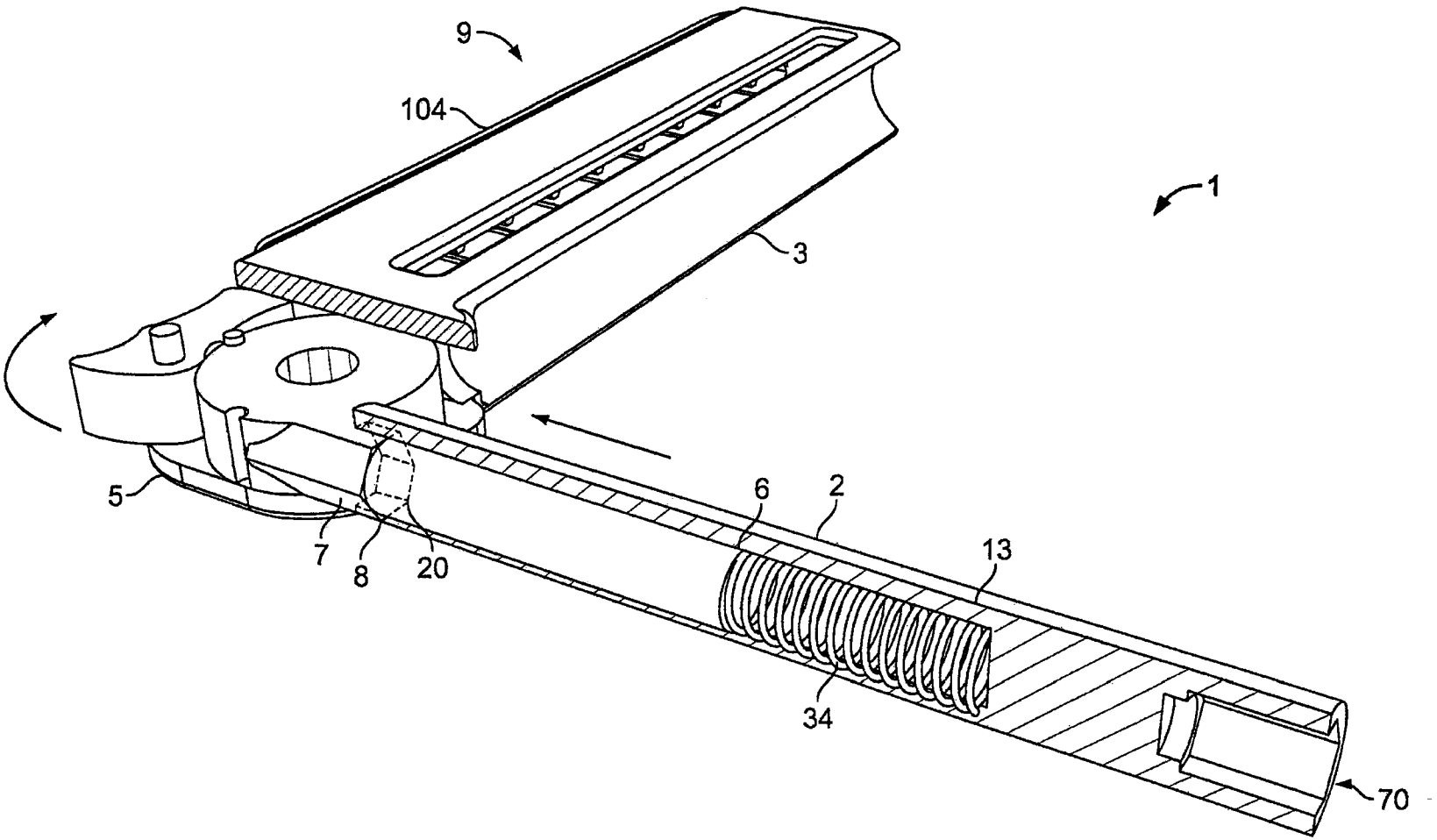
FIG. 27 is a partial cut-away view of the hand tool of FIG. 24 in the semi-opened configuration in a second operative position.
Figure 28:
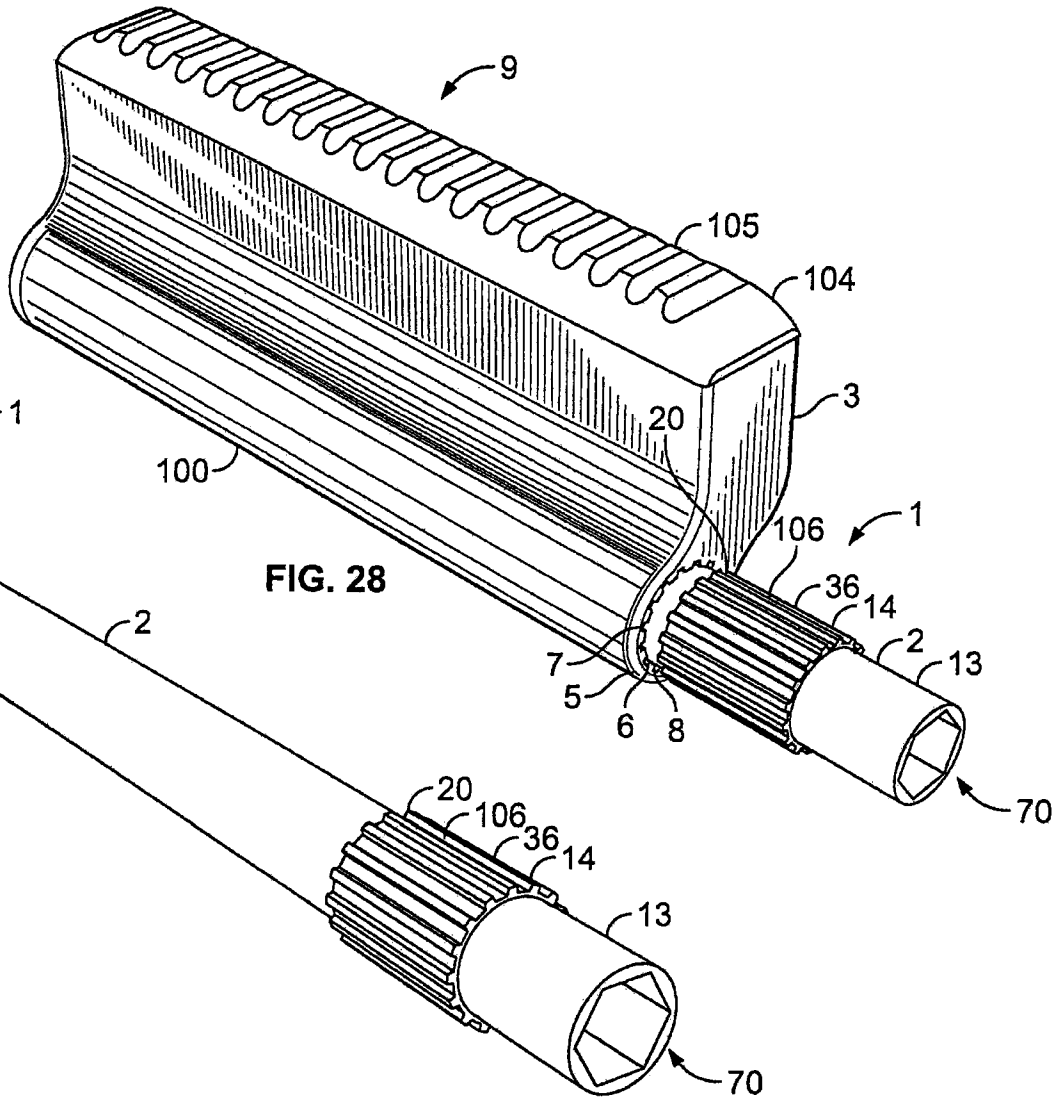
FIG. 28 is a perspective view of the hand tool with torque drive shaft where a manual biasing force is required on the driving shaft according to another embodiment of the present disclosure.
Figure 29:
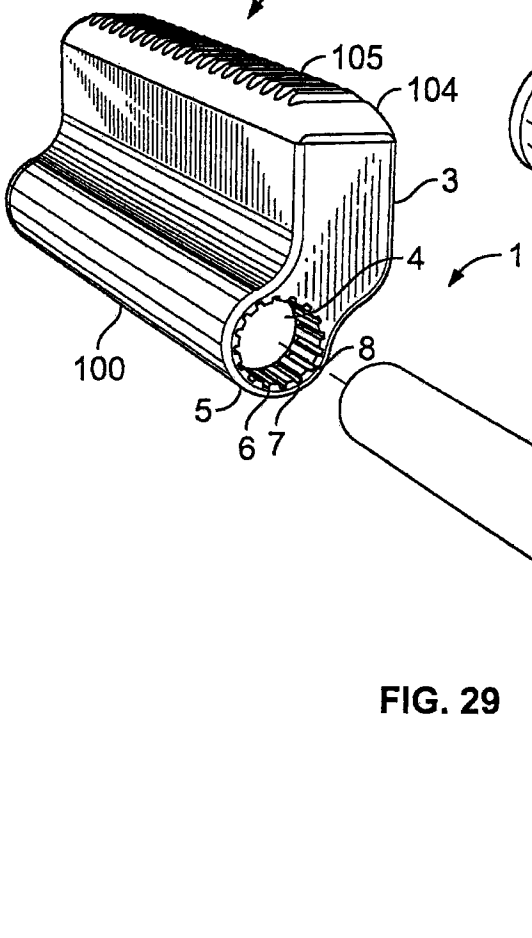
FIG. 29 is an exploded perspective view of the hand tool of FIG. 28.
Figure 30:
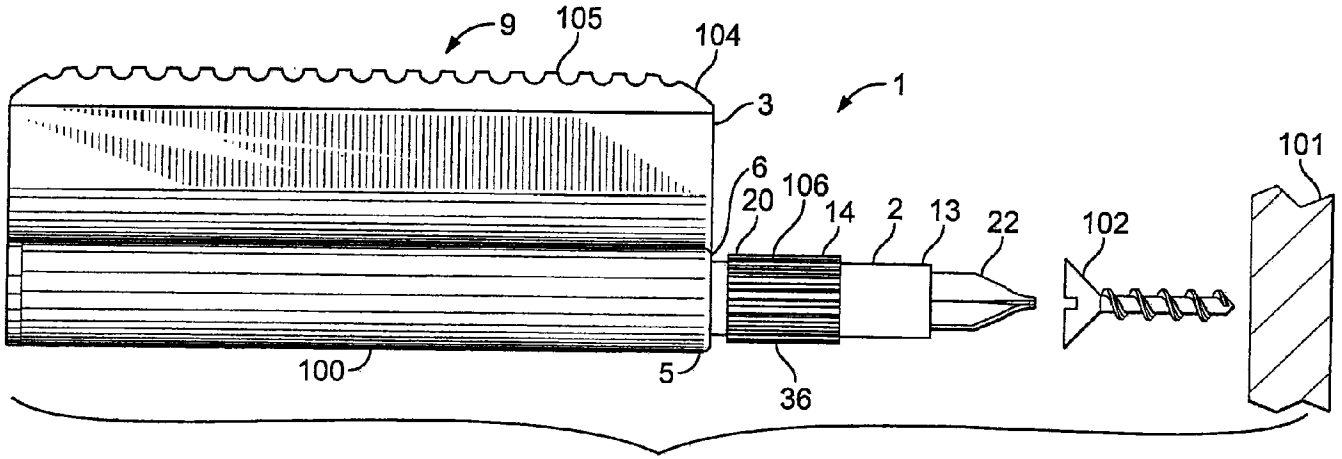
FIG. 30 is a side elevation view of the hand tool of FIG. 28 in a first operative position.

FIGS. 24-27 show yet another embodiment of the hand tool 1 according to a fourth embodiment where the drive assembly is freestanding and the biasing force is made by an inner spring 34 to move the drive assembly 2 from a second engaged operating position shown in FIG. 27 to a first disengaged operating position shown in FIG. 26. The embodiment shown in FIGS. 24-27 is also capable of operation in the second engaged operation when the hand tool 1 is in closed position as shown on FIG. 24 in a holster (not shown).

Figure 32:
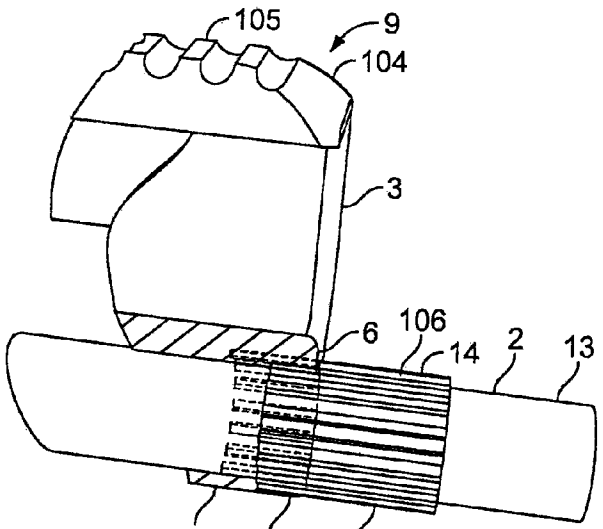
FIG. 32 is a partial cut-away view of the hand tool of FIG. 28 in the second operative position.
Figure 31:
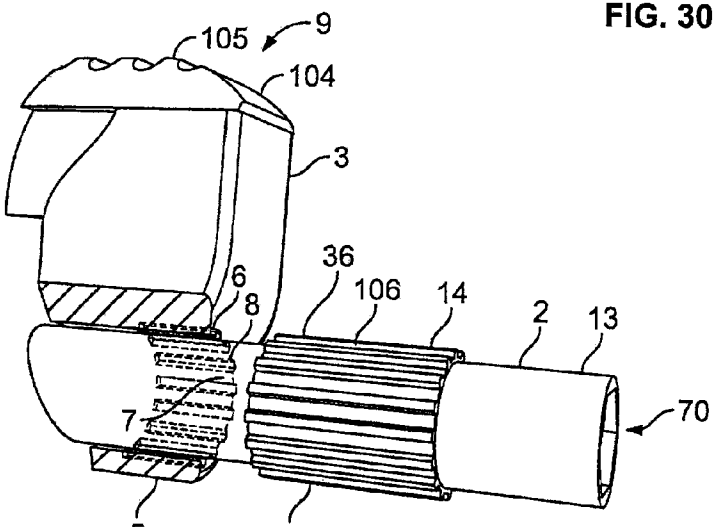
FIG. 31 is a partial cut-away view of the hand tool of FIG. 28 in the first operative position.

FIGS. 28-32 show yet another further embodiment of the hand tool 1 according to a fifth embodiment where the biasing force to disengage the drive assembly 2 from a second engaged operating position shown in FIG. 32 to a first disengaged operating position shown in FIG. 31 is made manually. The force to engage the drive assembly 2 from the first operating position to a second operating position corresponds to the axial push force placed upon a work element 101 when a user desires to engage the hand tool 1 and transfer torque to a work piece 22 and ultimately to the work element 101.

FIGS. 35-41 show yet another embodiment of the hand tool 1 according to a sixth embodiment where a coupler 200 is used as part of the drive assembly 2 where the force needed to offset a biasing force in the coupler 200 and engage the drive assembly 2 is obtained by either a push of housing 3 on a work piece 22 or a pull of the coupler 200 against the housing 3.

Figure 7:
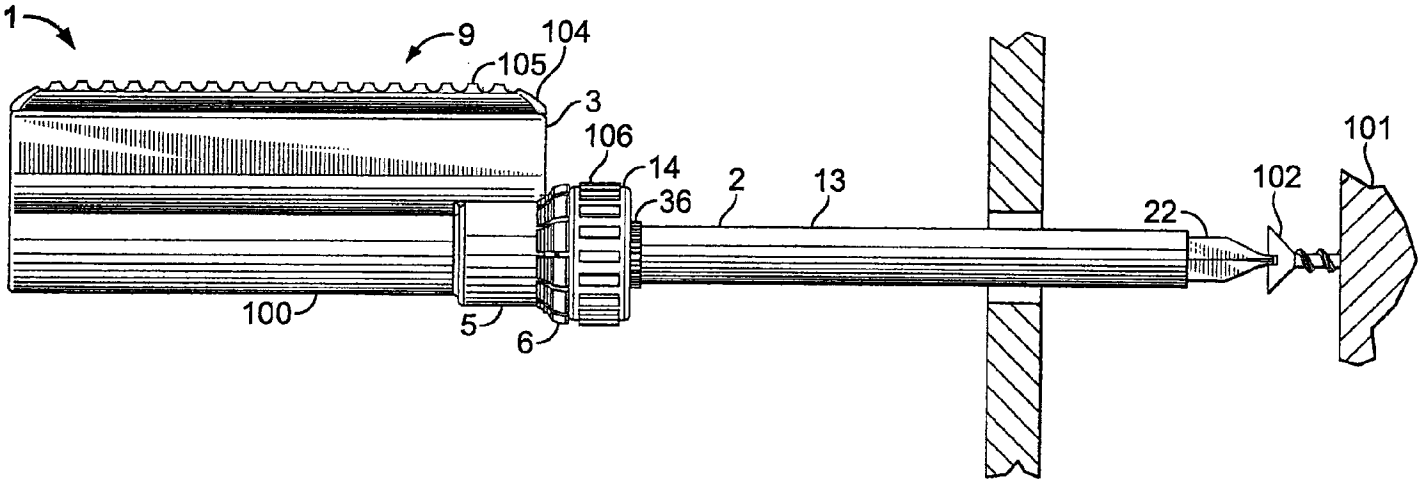
FIG. 7 is a side elevation view of the hand tool with torque drive shaft as shown in one of the alternate embodiments of FIG. 6 equipped with the extracted shaft.
Figure 8:
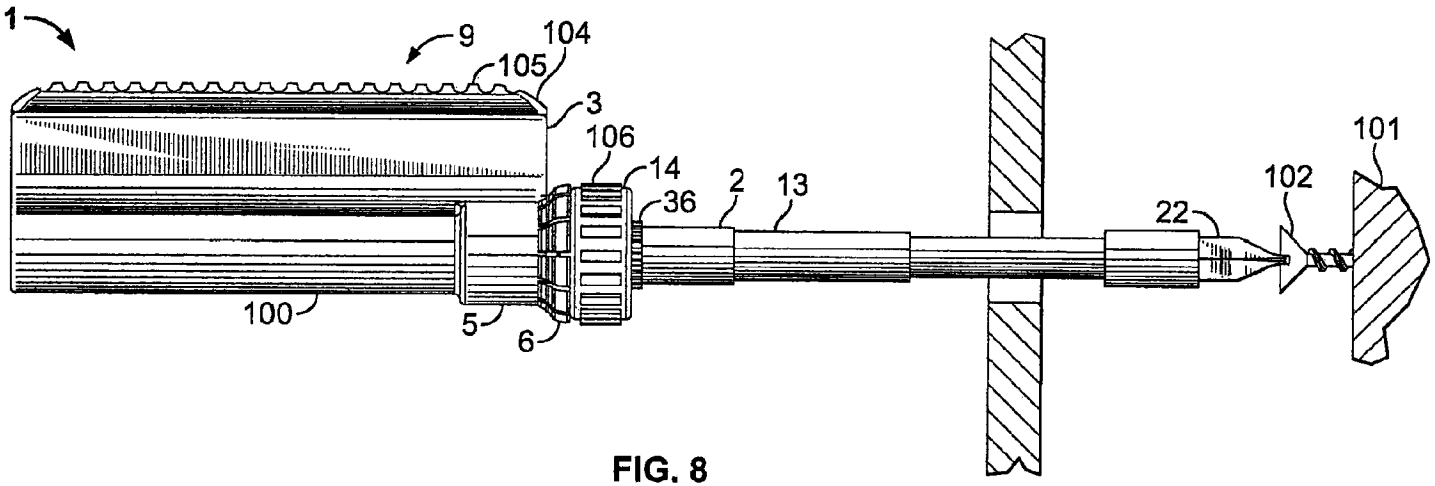
FIG. 8 is a side elevation view of the hand tool with torque drive shaft as shown in one of the alternate embodiments of FIG. 6 equipped with the telescoping shaft.
Figure 9:
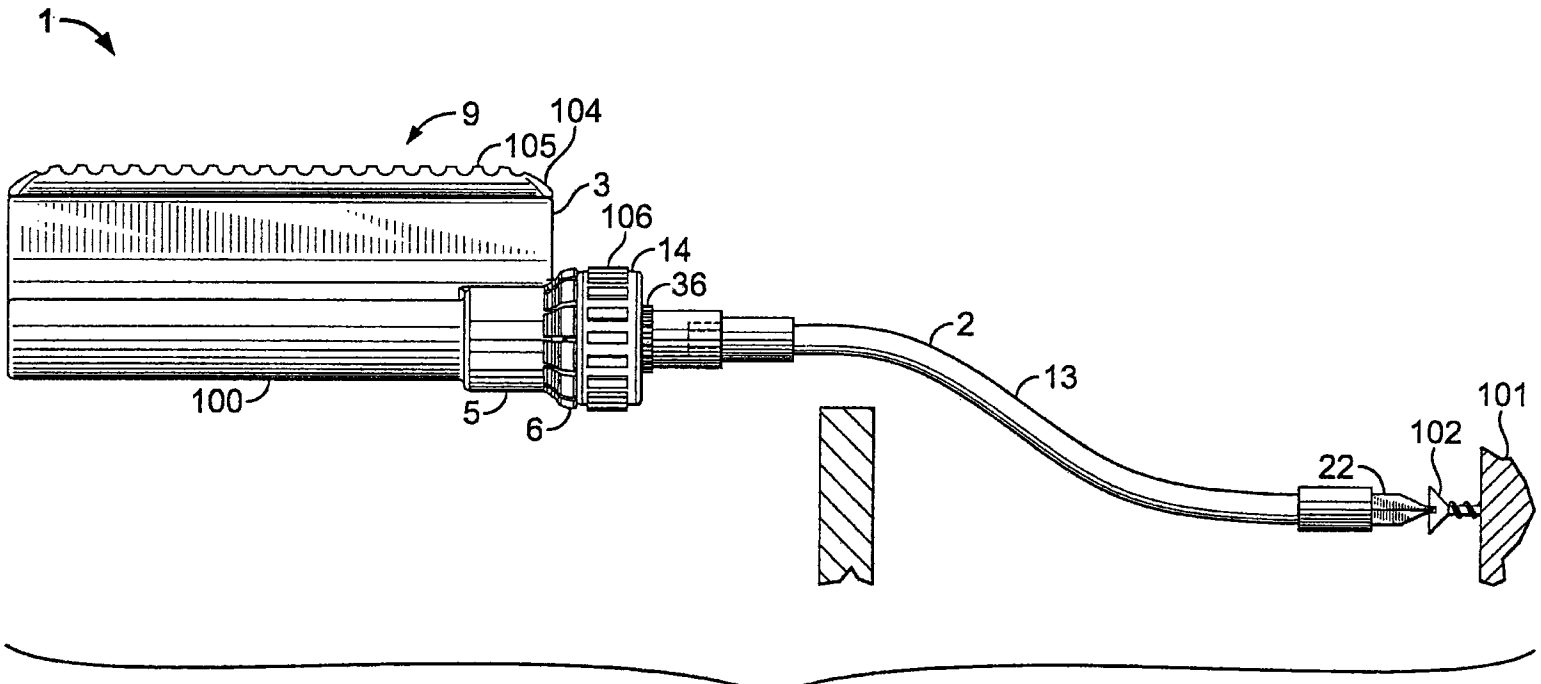
FIG. 9 is a side elevation view of the hand tool with torque drive shaft as shown in one of the alternate embodiments of FIG. 6 equipped with the flexible shaft.

What is shown in FIG. 1 is a hand-held tool 1 with a generally cuboid housing 3 with a protuberance 100 offset from the main axis formed by the drive assembly 2. In this embodiment, a user places the protuberance 100 in the palm of the hand. A storage element compartment 9 or any other offset volume is then gripped between the palm and the four fingers with the head portion 5 placed next to the index finger in an upright position. A work piece 22 is then inserted into the first receptacle 70 if the hand tool 1 is used as a tool to transfer force to an element such as a screw 102 fixed at a location, such as a work element 101 as shown in FIGS. 7-9.

By way of example, FIG. 16 shows one embodiment where a work piece 22 is used to connect with a fastener 103 on a work element 101. One of ordinary skill in the art understands that what is also contemplated is the use of any other possible work piece 22 that may be used in association with the hand tool 1, or configurations where a work piece 22 is formed as an integral part of the drive shaft 13, or even tools where the fastener 103 or any mechanical element can be inserted directly within the first receptacle 70 on the drive shaft 13 or any other such functional uses to enable a work piece 22 to conduct work on a surface. In one embodiment as shown in FIG. 16, the fastener 103 is a bolt.

Figure 2:
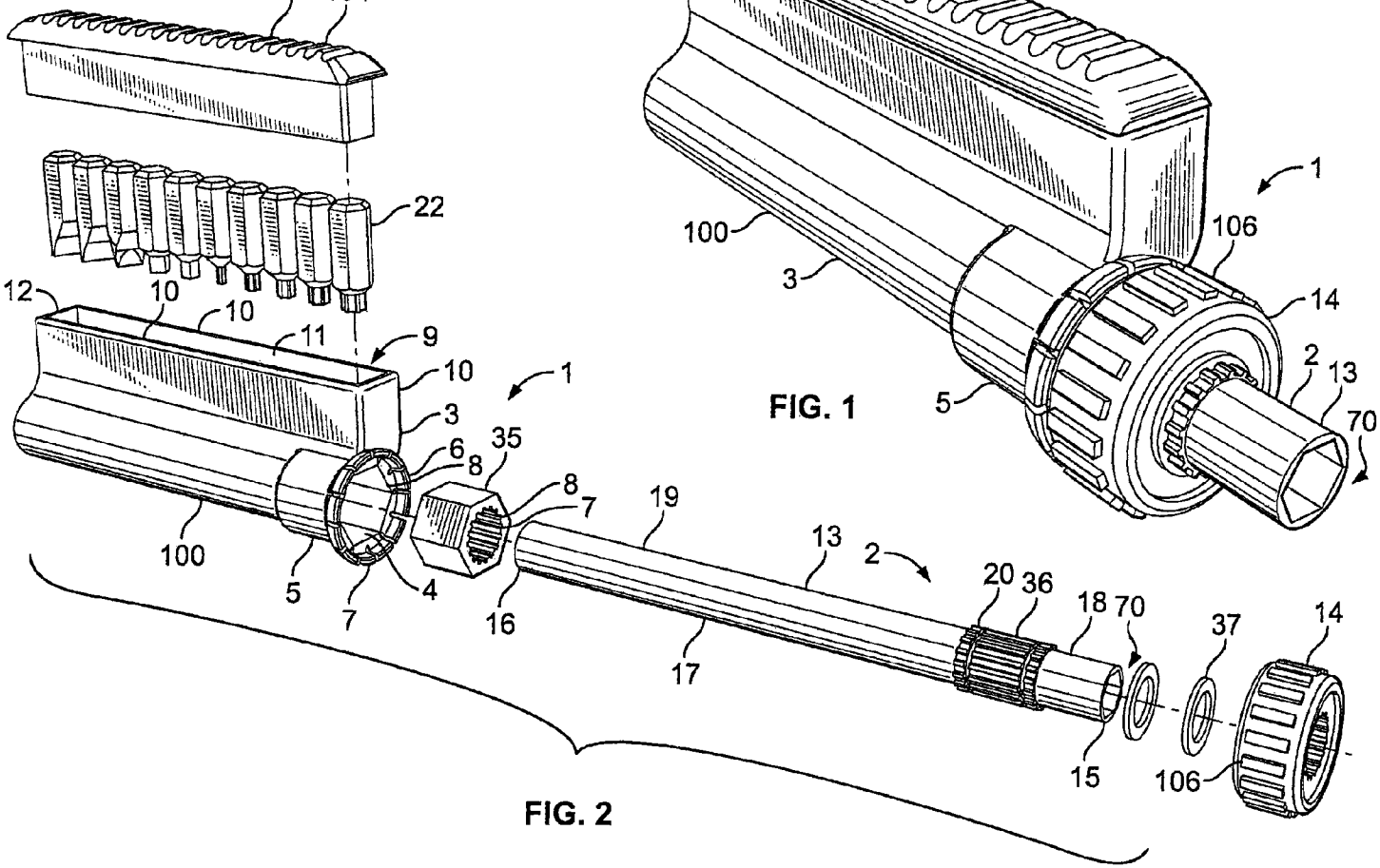
FIG. 2 is an exploded perspective view of the hand tool with torque drive shaft as shown in FIG. 1.
Figure 3:
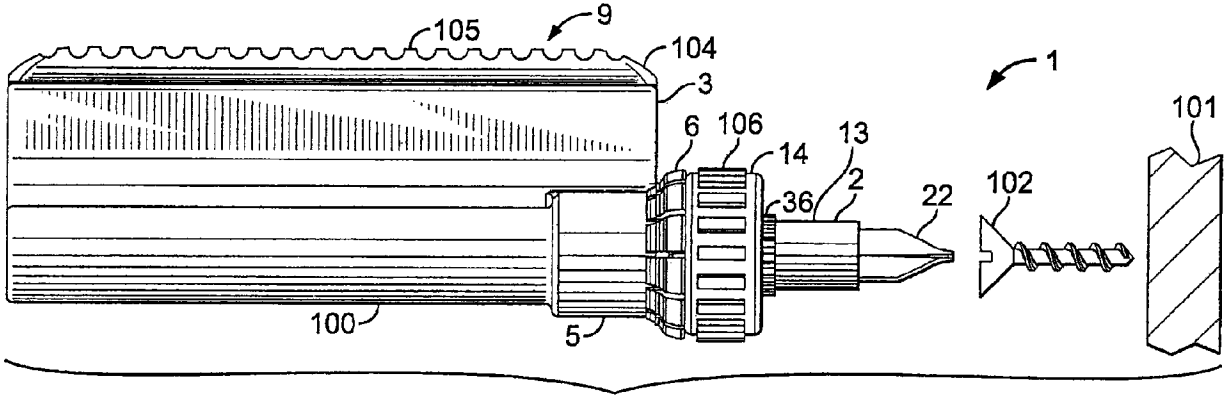
FIG. 3 is a side view of the hand tool with torque drive shaft as shown in FIG. 1.

FIG. 2 is an exploded view of one possible embodiment the hand tool 1 where a series of work pieces 22 are stacked vertically within the storage element compartment 9 and covered with a protector 104 made to confine the work pieces 22 within the storage element compartment 9. The protector 104 also includes a series of external ridges 105 in contact with the hand of a user to increase the gripping efficacy of the hand tool 1. The hand tool 1 is ergonomically designed to be held by a user and is made of any suitable material capable of withstanding the different internal and external shear forces and constraints commonly associated with a hand tool 1. In one possible embodiment, the housing 3 and the protector 104 are made of a nondeformable polymer, a shape-retaining material, and/or high-resistance polymer blend while the other components are made of steel, metal, ceramic, composite, or natural ceramic mesh compound such as Kevlar. What is also disclosed and contemplated is the use of any suitable material recognized by one of ordinary skill in the art of such design thickness in relevant bending sections to allow for sections to be carved out and rotated around a fixed point without permanent deformation to create elements capable of producing a biasing force between different elements of the hand tool 1 at appropriate locations.

The work piece 22 in one embodiment is located at the end of the drive assembly 2, and more precisely, at the end of the drive shaft 13. The user operates either an actuator 14 or the drive shaft 13 directly when no actuator 14 is available when the drive shaft 13 is in the first operative position or the freewheeling mode. In one preferred embodiment, the user rotates the actuator 14 using the thumb and the index finger or the middle finger while holding the housing 3 with the ring finger and the little finger against the palm of the hand. What is disclosed is only one of a plurality of possible hand and finger placements, given as a nonlimiting example to understand how the freewheeling mode is operated by a user. While one possible mode of operation is disclosed, what is contemplated is the use of the hand tool 1 by a user in association with any part of the hand or with other tools. Figures show the actuator 14 or other external parts of the hand tool 1 with surface notches 106 or other type of surface irregularities designed in part to increase the fiction between the actuator 14 and an operating finger, limit rotational movements, and/or increase the overall aesthetics of the hand tool. In one embodiment, the drive shaft 13 is movably rotated by using an external surface of the biasing element located on the drive shaft 13. As a nonlimiting example, if a small O-ring is used as a biasing element where the surface of the O-ring is compressed between the actuator 14 and the housing 3, the middle section of the O-ring located between both surfaces of compression can be made accessible to the user of the hand tool 1 for rotation of the drive shaft in the disengaged operating position.

Figure 4:
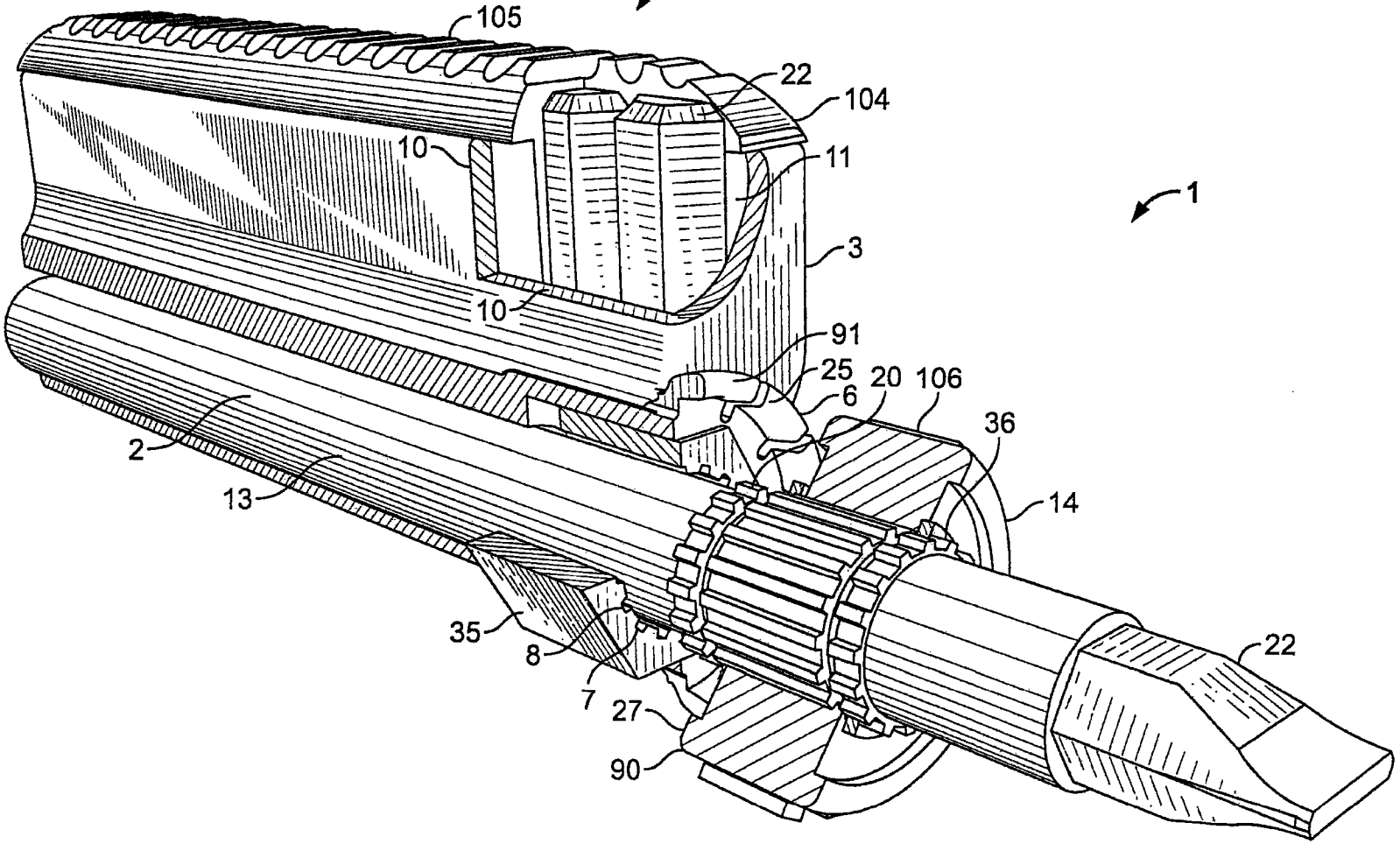
FIG. 4 is a perspective partial cross-sectional view of the hand tool with torque drive shaft as shown in FIG. 1 in a first disengaged operative position.
Figure 34:
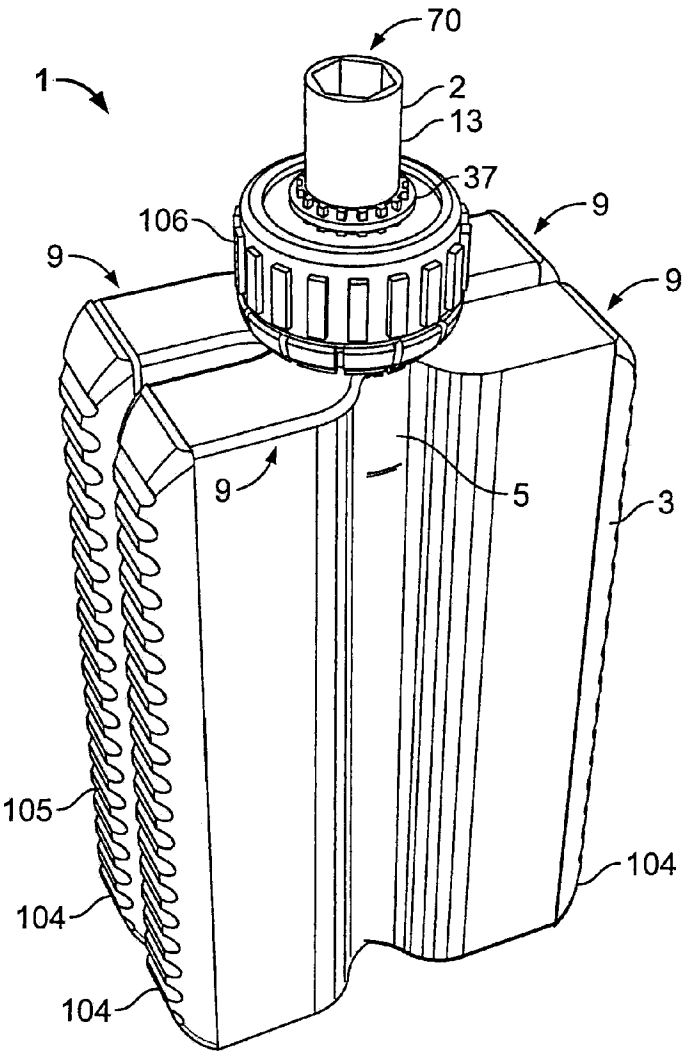
FIG. 34 is a perspective view of the hand tool shown in FIG. 1 with a quadruple storage element compartment according to another possible embodiment of the present disclosure.
Figure 33:
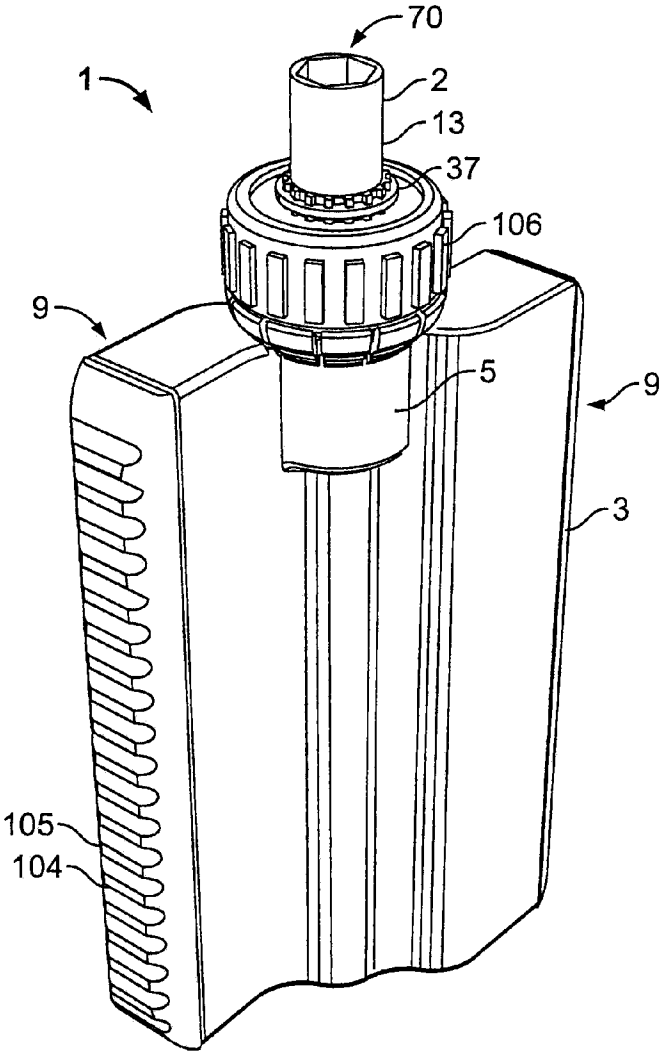
FIG. 33 is a perspective view of the hand tool shown in FIG. 1 with a double storage element compartment according to another possible embodiment of the present disclosure.

The hand tool 1 includes a housing 3 as shown in the exploded perspective view of FIG. 2. The housing 3 includes a bore 4 defined therein, a first end 6 of the housing 3 defining a first coupling element 7 that may be disposed on an inner surface 8 or disposed about the bore 4, and a storage element compartment 9 made of a plurality of walls 10 contiguous with the housing 3 to define a cavity 11 and an opening 12. The bore 4 is shown in FIGS. 2 and 4. The bore 4 as shown in one embodiment is cylindrical in shape, with a constant longitudinal diameter slightly greater than the external diameter of the drive shaft 13 to be inserted fully or partly therein. In one embodiment, the bore 4 is made throughout the housing 3, but what is contemplated is the use of a bore 4 of sufficient geometry, size, and length to accommodate the drive shaft 13 and allow for the engaging mechanism of the drive assembly 2 to operate. By way of nonlimiting example, the use of a bore 4 of sufficient size and length could lead to additional storage space for additional work pieces 22 within the drive shaft 13 or the housing 3. FIGS. 33-34 show a configuration where the housing 3 comprises additional storage space for additional work pieces 22. What is also contemplated is a bore 4 that does not traverse the housing 3 and leaves an end plate (not shown) where a biasing element such as a spring 34 may be housed to create a biasing force between the end plate (not shown) and the drive shaft 13 to return an engaged drive assembly 2 to the freewheeling mode.

The head portion 5 is shown in FIG. 1 with a slightly greater diameter than the protuberance 100 to maintain a mechanical resistance of the housing in light of the insert 35 placed at the first end 6. The head portion 5 is located at the first end 6 of the housing 3. While it is understood by one of ordinary skill in the art that the housing is designed to have a minimum weight and volume, any ergonomic design or other housing design to be placed in a hand is also contemplated and acceptable. While a protector 104 with ridges 105 is shown, what is contemplated is any storage system, including but not limited to a bottom or side sliding mechanism with or without biasing elements, the placement on the housing 3 of magnets or sliding elements where a module can be slid in place, and the like.

The drive assembly 2 with a drive shaft 13 is removably disposed at least partially within the bore 4. An actuator 14 disposed on the drive shaft 13 and a biasing mechanism or a manual biasing force is used for generating a biasing force that acts on the actuator 14 and the housing 3 so that the drive shaft 13 is normally disposed in a first disengaged operative position and pushed into the second engaged operative position. What is shown and contemplated is the use of any type of mechanism that allows the drive shaft 13, with or without an actuator 14, to slide a short distance into the housing with an axial force to enable a mechanical lock between the housing and the drive shaft 13 and induce a biasing force capable of sliding the drive shaft 13 out of the housing 3 in an unlocked configuration. In one embodiment, the drive shaft 13 is slid approximately 1 mm into the housing. One of ordinary skill in the art recognizes that a wide range of biasing elements, including but not limited to magnets, springs, plates, liquids, elastomeric bands, O-rings, rings, and the like, can be used to bias the drive shaft 13 and the housing 3 to unlock the two elements once the torque force associated with an axial drive force is no longer present on the drive shaft 13. One of ordinary skill in the art also recognizes that a biasing element with a built-in capacity to create a force in opposition to any deformation, such as a flexible collar, a polymer, an elastomer band, or materials with a memory, may be used to control the axial deformation from the first operating position to the second operating position and back from the second operating position to the first operating position.

Figure 6:
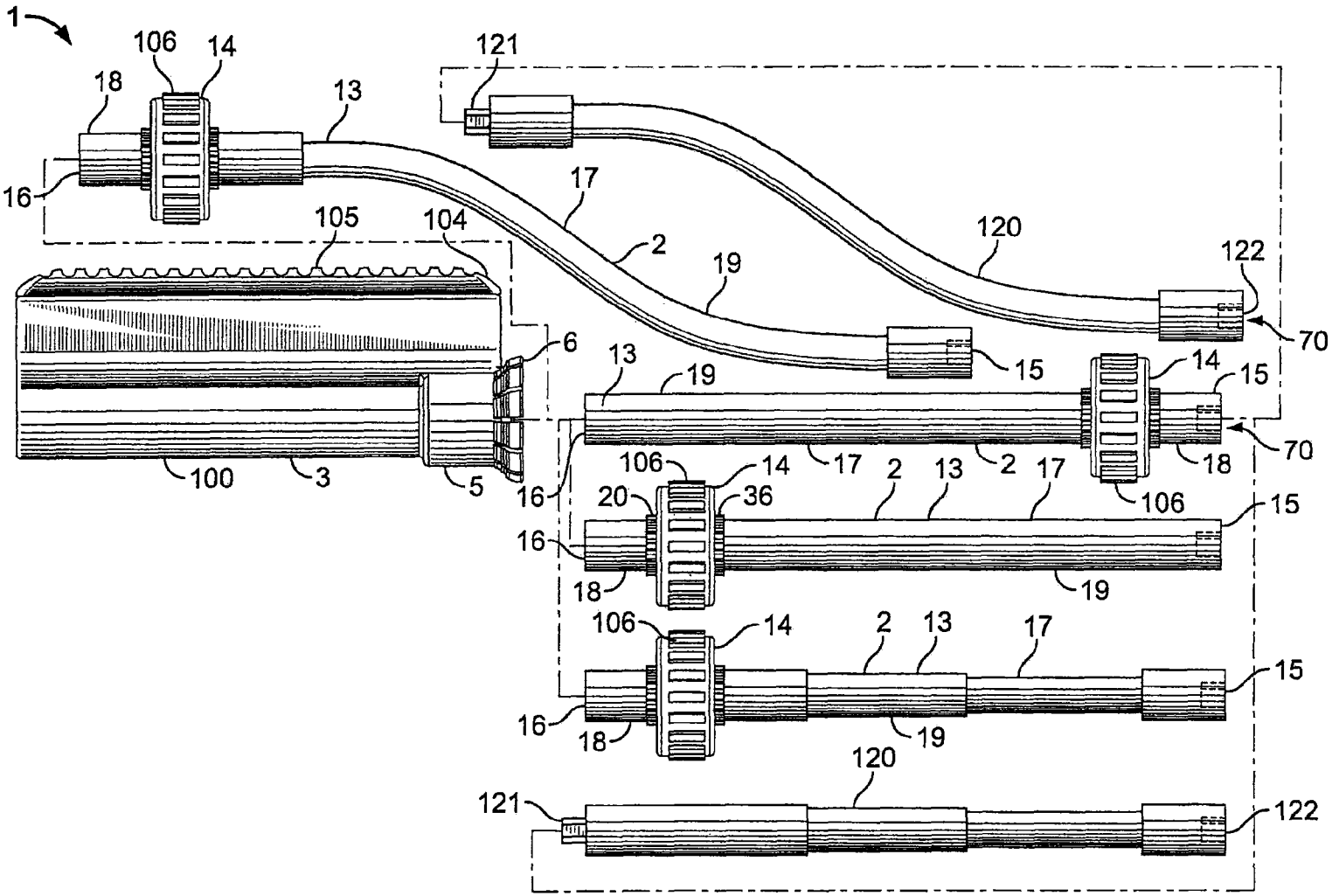
FIG. 6 is a side elevation view of the hand tool with torque drive shaft as shown in FIG. 1 with an alternate orientation and alternate torque drive shafts according to other possible embodiments.

In other embodiments, the hand tool 1 includes an actuator 14 integrally formed on the drive shaft 13 or coupled to the drive shaft 13. FIG. 2 shows one possible type of coupling of the actuator 14 on the drive shaft 13 using a raised section 36 locked in place by two clips 37 on each side of the actuator 14. While one possible mode of assembly is shown, what is contemplated is any type of assembly, including but not limited to a drive shaft 13 with an integral built-in actuator 14. In one preferred embodiment, a crenellated surface on the drive shaft 13 is used. The drive shaft 13 includes a first end portion 15 having a first receptacle 70 designed to accommodate a work piece 22. The drive shaft 13 also includes in one embodiment a second end portion 16 with a second receptacle 21 (not shown in FIG. 2 but symmetrical to the first receptacle 70 as shown). The intermediate portion 17 of the drive shaft 13 is shown as being located between the first end portion 15 and the second end portion 16. In one embodiment as shown in FIG. 2, the first end portion 15 has a first longitudinal length 18 that is less than a second longitudinal length 19 of the second end portion 16. The drive shaft 13 with different longitudinal lengths 18, 19 can be removed and turned as shown in FIG. 6, or other secondary lengths of flexible shaft 120 can be used as shown in FIG. 6, such as other telescopic lengths or flexible lengths with male 121 and female 122 connectors. These shafts can also be made flexible 50 as shown in FIG. 9, or telescopically extendable 51 as shown in FIG. 8. FIG. 6 illustrates three different drive shaft 13 configurations in a side-by-side comparison. What is also contemplated is the use of any type and geometry of drive shaft 13, including but not limited to an L-shaped drive shaft 13 and the like.

Figure 5:
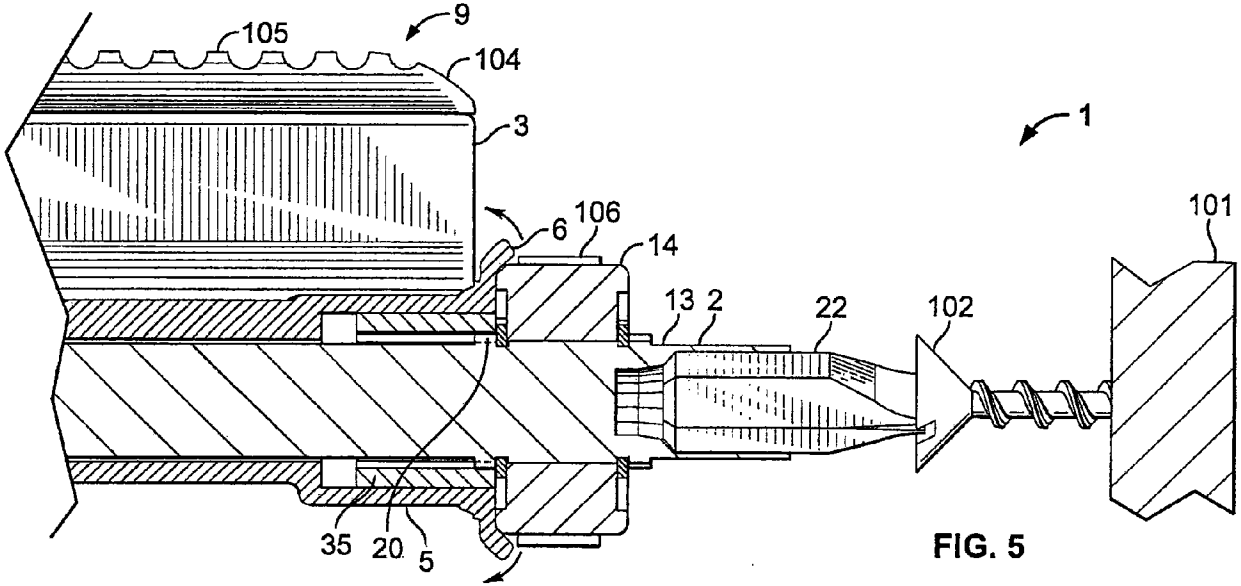
FIG. 5 is a side cross-sectional view of the hand tool with torque drive shaft as shown in FIG. 1 in a second engaged operative position.

The intermediate portion 17 includes a second coupling element 20 complementary to the first coupling element 7. The actuator 14 is movable with respect to the housing 3 when the drive shaft 13 is disposed in the first operative position. FIG. 4 shows the drive shaft 13 in the first operative position where the second coupling element 20 is not engaged with the first coupling element 7. FIG. 5 shows the drive shaft 13 in the second operative position where the second coupling element 20 is engaged with the first coupling element 7. The drive shaft 13 is also movable from the first operative position to a second operative position when the biasing force between the housing 3 and the driving assembly 2 is overcome. In one embodiment, the biasing force needed to move the drive shaft 13 from the first operative position to the second operative position corresponds to a small push from the hand or a force of less than 1 pound. What is shown in FIGS. 1-5 is a housing 3 capable of impermanent deformation to create a biasing force upon the actuator 14.

Figure 10:
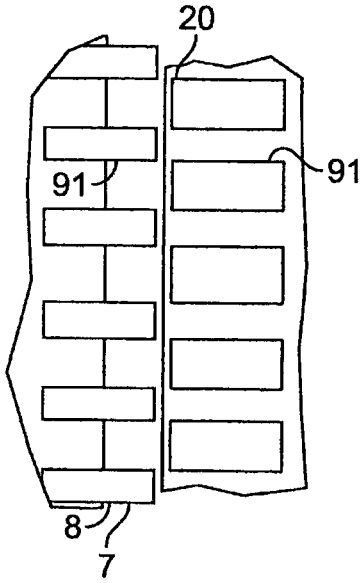
FIG. 10 is a close-up diagrammatic view of the engagement mechanism between a first coupling element and a second coupling element in a disengaged configuration.
Figure 11:
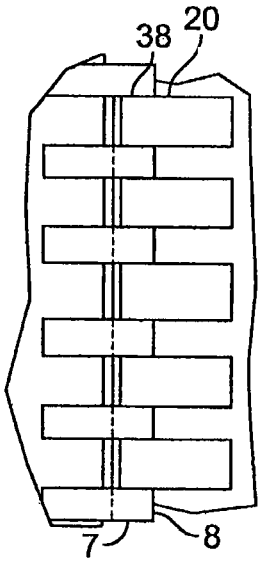
FIG. 11 is a close-up fractional sectional view of the engagement mechanism as shown in FIG. 10 in the engaged configuration.

FIG. 2 shows an actuator 14 immovable with respect to the housing 3 when the drive shaft is disposed in the second operative position as shown in FIG. 5. The first coupling element 7 and the second coupling element 20 are engaged in the second operating position such that movement of the housing 3 translates into movement of the drive shaft 13. FIG. 10 illustrates the interlocking of one possible geometry of first coupling element 7 to a complimentary geometry of the second coupling element 20 in a first position, and FIG. 11 shows the first coupling element 7 and the second coupling element 20 in the second operating position. One of ordinary skill in the art recognizes that while a series of parallel teeth are shown as geometries of the first coupling element 7 and the second coupling element 20, what is contemplated is the use of any type of first coupling element capable of interlocking, sliding, attaching, or contacting with a second coupling element to transfer a torque placed upon the housing 3 to the drive shaft 13 on which the second coupling element 20 is placed 38 as shown in FIG. 11.

Figure 12:
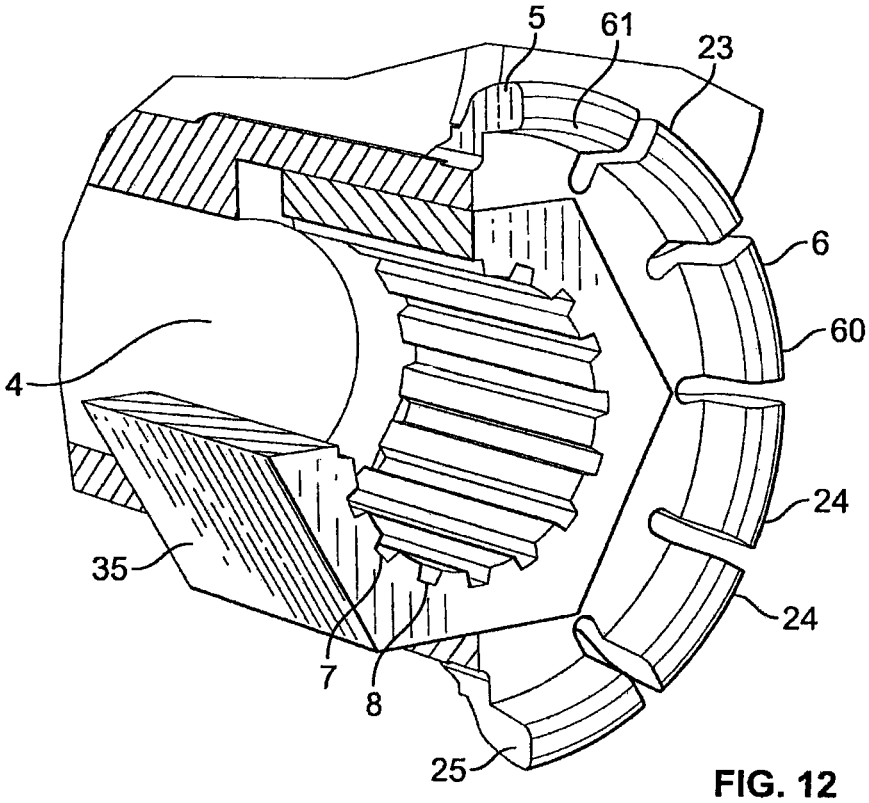
FIG. 12 is a detailed cut-away view of the head portion of the hand tool with insert and a segmented lip as shown in FIG. 1.

FIG. 12 shows an embodiment where the biasing mechanism has a lip 23 defined on a distal end 60 of the head portion 5 having an inner edge 61 that defines a socket diameter 25. The lip 23 includes a plurality of circumferentially spaced segments 24. One of ordinary skill in the art recognizes that segments 24 are shown illustratively as one possible way to create a localized weakness in the lip 23 to allow for impermanent deformation of the lip 23 when in contact with a force to move the drive shaft 13 from a first operating position to the second operating position that requires the lip to move as shown by the arrows in FIG. 5. In one preferred embodiment, the lip 23 is crenellated.

In one embodiment shown in FIG. 4, the actuator 14 also has an outer surface 26 that defines an actuator diameter 27 that is not less than the socket diameter 25 such that the biasing force generated opposes movement of the drive shaft 13 from the first operative position as shown in FIG. 4 to the second operative position as shown in FIG. 5. In one embodiment, the actuator includes a ridge 90 disposed on the outer surface of the actuator 14 for registration between adjacent segments 91 when the drive shaft 13 is disposed in the second operative position as shown in FIG. 11.

Figure 13:
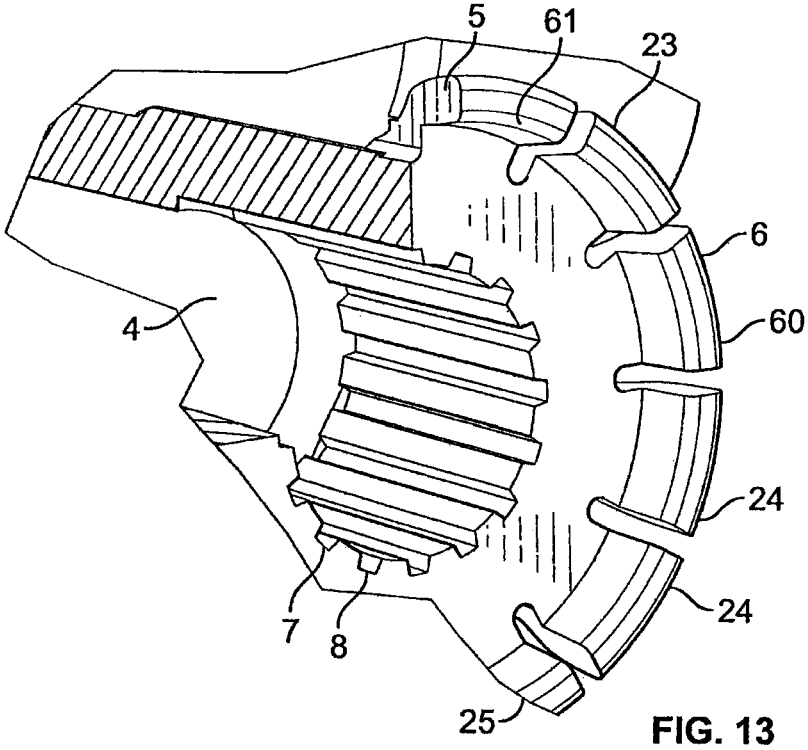
FIG. 13 is a detailed cut-away view of the head portion of the hand tool as shown in FIG. 12 without the insert.
Figure 15:
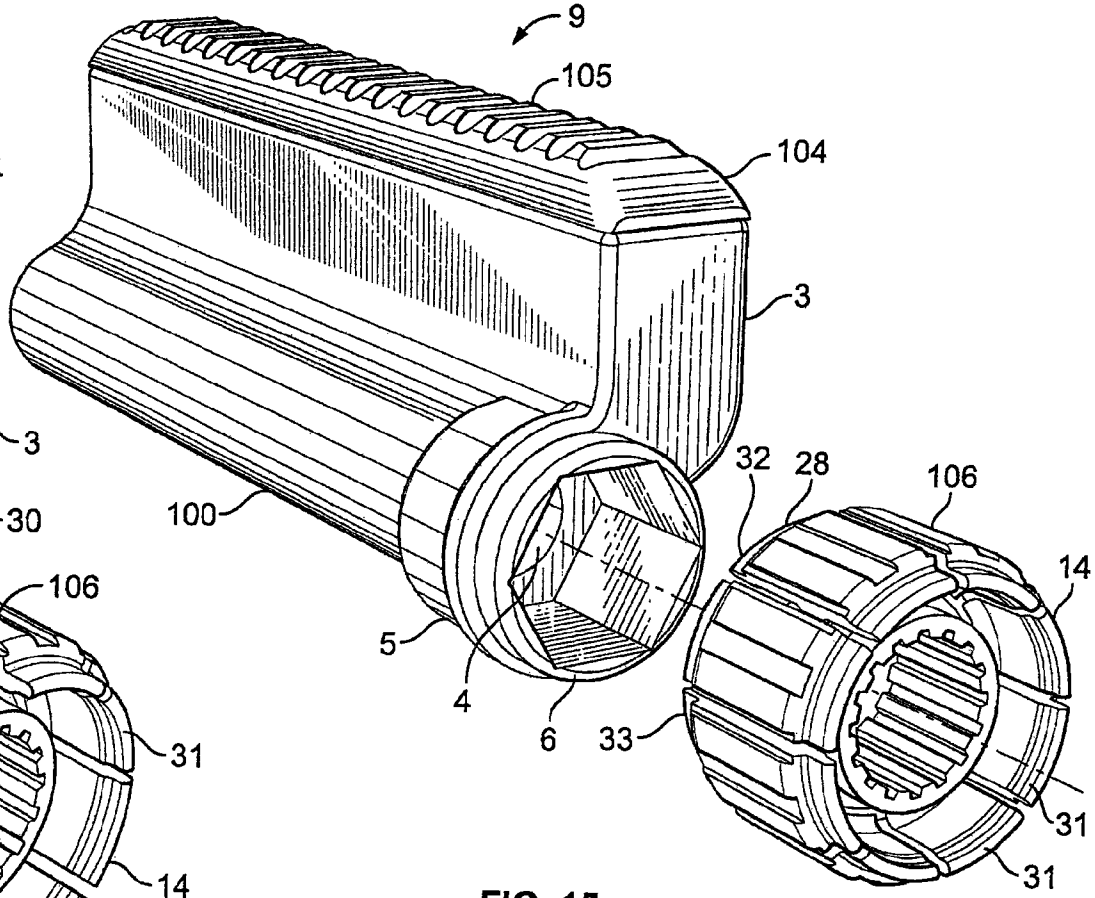
FIG. 15 is a perspective view of the hand tool without the insert as shown in FIG. 14.
Figure 14:
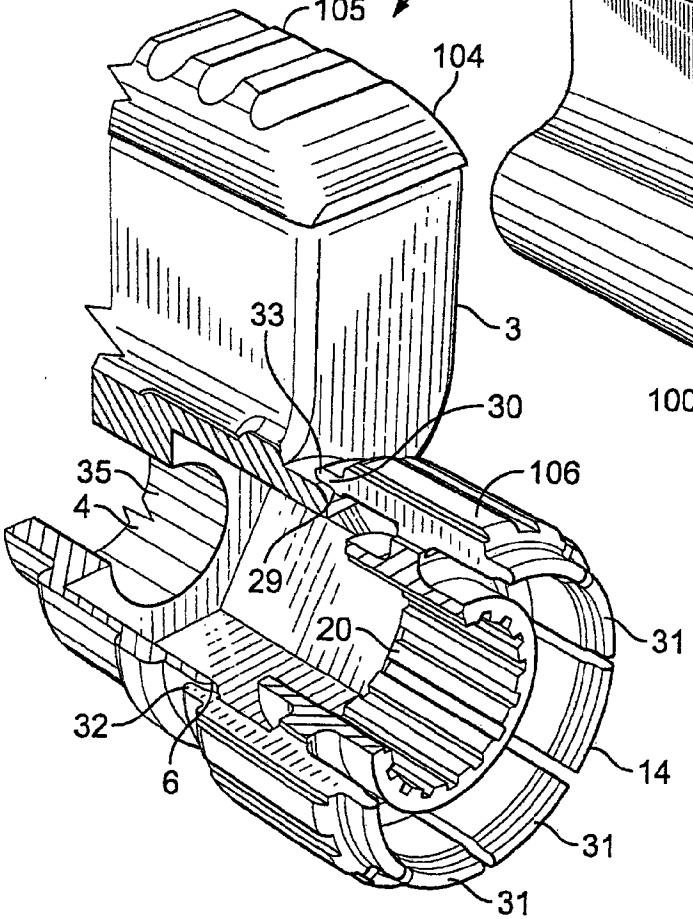
FIG. 14 is a detailed cut-away view of the head portion of the hand tool with torque drive shaft where the biasing force is made by the actuator without the insert according to another embodiment of the present disclosure.
Figure 19:
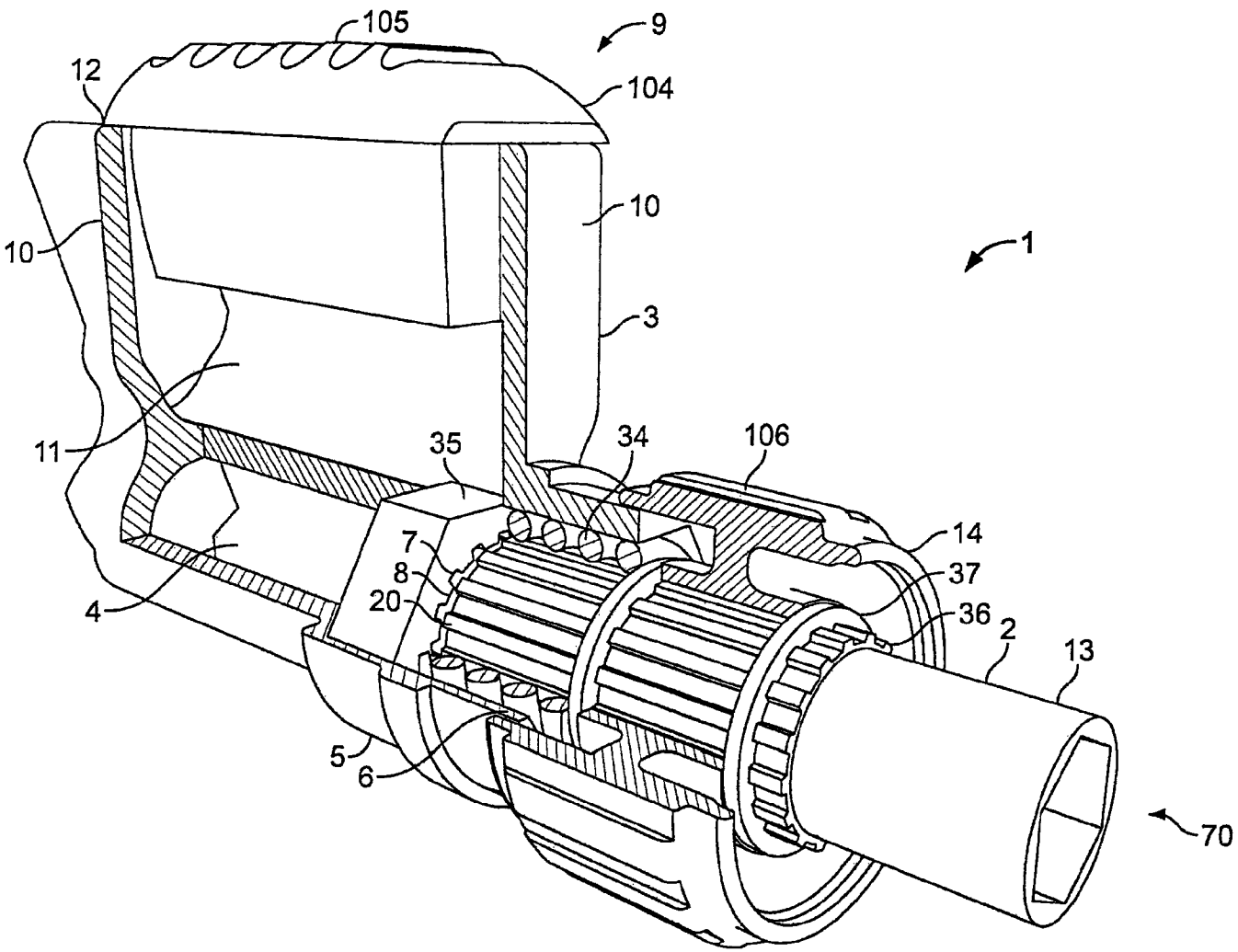
FIG. 19 is detailed a cut-away view of the head portion and actuator of the hand tool with torque drive shaft where the biasing force is made by a spring on the actuator with insert according to another embodiment of the present disclosure.
Figure 20:
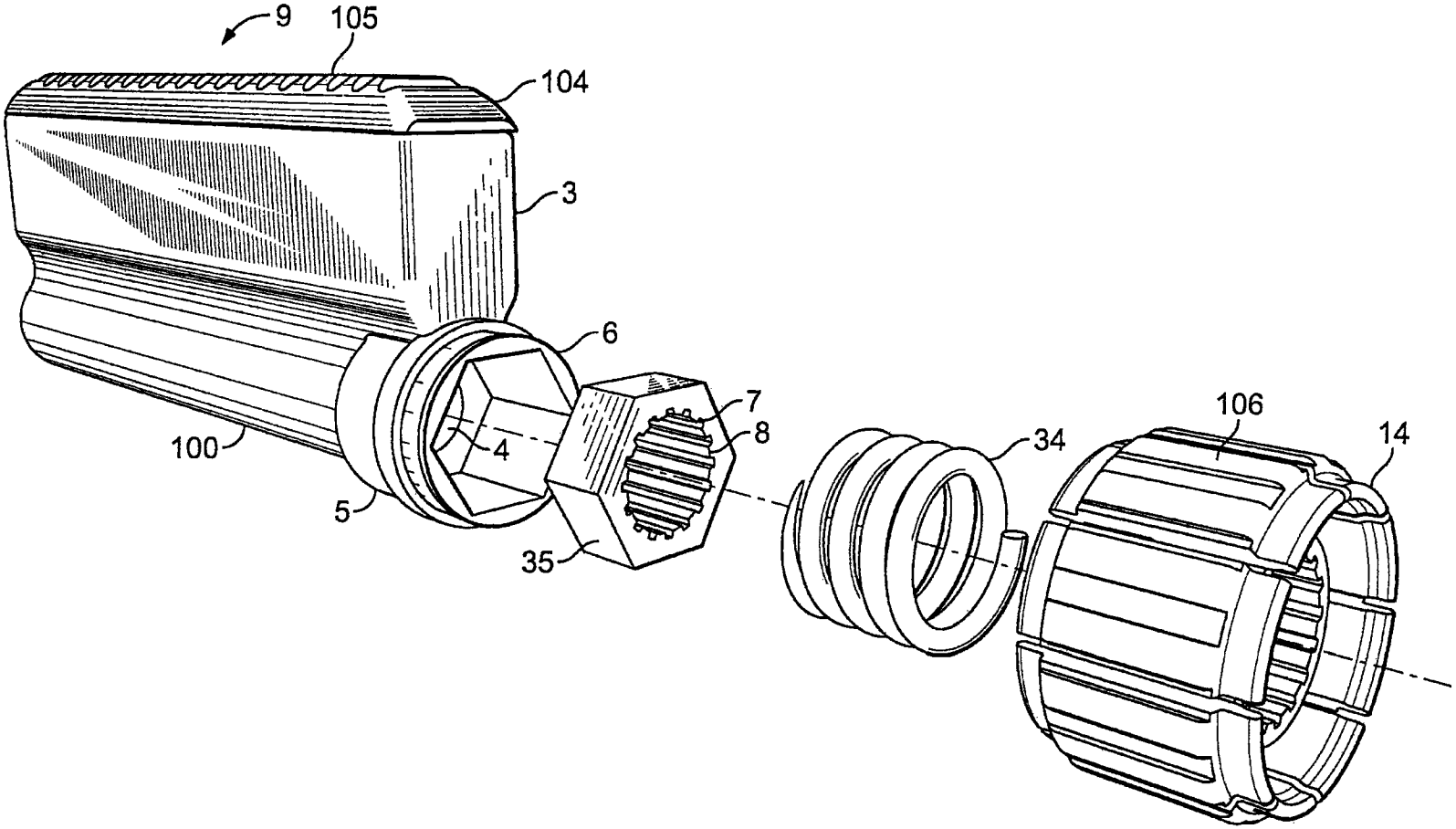
FIG. 20 is an exploded perspective view of the hand tool of FIG. 19 without the driving shaft.
Figure 21:
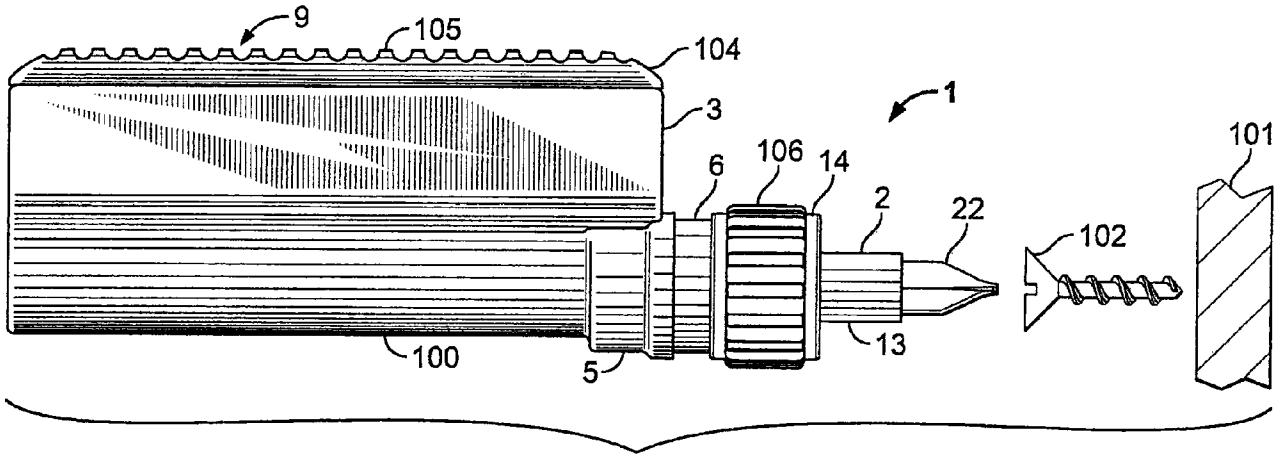
FIG. 21 is a side election view of the hand tool of FIG. 19 with work piece.

FIGS. 14-18 show a biasing mechanism with a rim 28 defined on the actuator 14 including an inner edge 29 that defines a rim diameter 30. The rim 28 as shown in FIG. 17 defines a plurality of circumferentially spaced segments 31. The head portion 5 on the housing 3 has a distal end 32 that defines a head diameter 33 that is not less than the rim diameter 30 such that the biasing force generated opposes movement of the drive shaft 13 from the first operative position to the second operative position as shown in FIGS. 17 and 18, respectively. In one embodiment, the biasing mechanism is a spring 34 as shown in FIG. 19 disposed between the first end 6 of the housing 3 and the actuator 14 such that the biasing force generated opposes movement of the drive shaft 13 from the first operative position to the second operative position. In one embodiment shown in FIG. 12, the inner surface 8 is defined on an insert 35 secured to the first end 6 of the housing 3. FIG. 13 shows an embodiment where the inner surface 8 is defined on the first end 6 of the housing 3.

In another embodiment, the hand tool 1 includes a housing 3 having a bore 4 defined therein, a storage element compartment 9 with a plurality of walls 10 contiguous with the housing to define a cavity 11, and an opening 12. The drive shaft 13 is removably disposed at least partially within the bore 4 with an actuator 14 on the drive shaft 13. What is also contemplated is the use of a drive shaft 13 with symmetrical ends that may be inserted in another opening made in the housing 3 or where the other end of the drive shaft 13 is inserted alternatively. The drive shaft 13 can be operated when functionally coupled with the housing 3 by moving the housing 3 or when in the second operating position can be operated by fingers of one hand. What is also contemplated is the use of hand actuation to translate the drive shaft 13 from a first operating position to a second operating position and from the second operating position back to the first operating position. The actuator 14 is also integrally formed on the drive shaft 13, and the actuator 14 is coupled to the drive shaft 13 and includes a first end portion 15 with a first receptacle 70, a second end portion 16 with a second receptacle 21 (not shown in FIG. 2 but symmetrical to the first receptacle 70), and an intermediate portion 17 disposed between the first end portion 15 and the second end portion 16. In one embodiment, the first end portion 15 has a first longitudinal length 18 less than a second longitudinal length 19 of the second end portion 16. The first coupling element 7 is defined about the bore 4 on an inner surface 8 and a second coupling element 20 is defined on the intermediate portion 17 that is complementary to the first coupling element 7 as shown in FIG. 2.

In another embodiment, the drive shaft 13 is movable with respect to the housing 3 in a first operative position as shown in FIG. 4 defined when the first coupling element 7 is disengaged from the second coupling element 20. In yet another embodiment, a movement of the housing 3 associated with torque to be transmitted by the hand tool 1 to the work element 101 translates into movement of the drive shaft 13 in a second operative position as shown in FIG. 5 when the first coupling element 7 is engaged with the second coupling element 20.

What is also claimed is a method of imparting work to a work piece according to another embodiment of the present invention. The method includes the steps of providing a hand tool 1 including a housing 3 and a drive shaft 13 disposed at least partially within the housing 3 and movable with respect thereto, engaging a work piece 22 to the drive shaft 13, and actuating the drive shaft 13 when disposed in the first operative position to impart work to the work piece 22. The method in another embodiment comprises the step of having a second coupling element 20 complementary to the first coupling element 7 such that the drive shaft 13 is disposed in a first operative position as shown in FIG. 4 when the first coupling element 7 is disengaged from the second coupling element 20 and a second operative position as shown in FIG. 5 when the first coupling element 7 is engages the second coupling element 20.

The method further includes the step of fitting a work element or work piece 22 adapted to engage the work piece 22 to the drive shaft 13. Finally, the method also includes the further steps of engaging the work element 101 when the drive shaft 13 is in the first operative position, actuating the hand tool 1 such that the drive shaft 13 is disposed in the second operative position to impart work to the work element 101.

In another embodiment shown in FIGS. 24-27, the hand tool 1 includes a housing 3 having a first end 6 of the housing 3, a drive assembly 2 with a drive shaft 13 movably connected to the first end 6 of the housing 3, and a biasing mechanism 72 for generating a biasing force located between a first end portion 15 of the drive shaft 13 and a first end 6 of the housing 3. The hand tool 1 also includes a storage element compartment 9 defined by a plurality of walls 10 contiguous with the housing 3 to define a cavity 11 and an opening 12. What is shown is a first end portion 15 with a first receptacle 70 and a first end 6 that includes a hub 75 to facilitate pivotal connection to the second end portion 16.

The hand tool 1 further comprises a lock mechanism 73 disposed on the first end 6 for selectively fixing the drive shaft 13 in a desired orientation as shown in FIG. 25, namely, a 90° orientation with respect to the storage element compartment 9. The lock mechanism 73 also includes a movable lock element 74 configured to engage the hub 75 on the housing 3. The hub 75 facilitates pivotal connection to the first end 6 of the housing 3, and the hub 75 includes a plurality of circumferentially spaced receptacles 76. In another embodiment (not shown), the hub 75 includes a plurality of circumferentially spaced projections (not shown). One of ordinary skill in the art understands that while a hub 75 with receptacles 76 is shown, the counterpart where the lock element 74 includes receptacles 76 is also contemplated and disclosed.

In one instance, the lock element 74 is pivotally connected to the first end 6 of the housing and the lock element 74 includes a protrusion configured to engage at least one of the receptacles 76. In another embodiment, the lock element 74 includes a recess (not shown) configured to engage at least one of the projections contemplated. The biasing mechanism in one embodiment shown in FIG. 25 includes a spring 72. FIG. 26 shows a configuration where the first end portion 15 is movable with respect to the first end 6 when the drive shaft 13 is disposed in a first operative position. FIG. 26 illustrates the drive shaft 13 in the first operative position, and FIG. 26 illustrates the drive shaft 13 in the second operative position.

In another configuration, the second end portion 16 is secured in registration with the first end 6 when the drive shaft 13 is disposed in a second operative position as shown in FIG. 27. The second end portion 16 includes an inner end having a second coupling element 20, and the head includes a first coupling element 7 that is complementary to the second coupling element 20. The housing 3 further comprises a holster 77 for receiving the drive shaft 13. What is also shown is a drive shaft 13 that is rotated using an external surface of the biasing element 34 as explained herebefore. The holster 77 also includes a lip (not shown) for holding the driving shaft 13 in the second operating position along a closed position along the housing as illustrated in FIG. 24. The hand tool 1 is usable in the closed position shown on FIG. 24 in the second operating position by rotating the hand tool 1. In yet another embodiment, the drive assembly 2 can be disassociated from the housing 3 by a user and used a second tool.

What is also claimed is a method of imparting work to a work piece according to the embodiment shown in FIG. 24. The method includes the steps of providing a hand tool 1 including a housing 3 having a movably connected drive shaft, the drive shaft 13 engaging a work piece 22 to the drive shaft 13, and actuating the drive shaft 13 when disposed in the first operative position to impart work to the work piece 22. The method in another embodiment comprises the step of having a second coupling element 20 complementary to the first coupling element 7 such that the drive shaft 13 is disposed in a first operative position when the first coupling element 7 is disengaged from the second coupling element 20 and a second operative position when the first coupling element 7 is engages the second coupling element 20.

The method further includes the step of fitting a work element or work piece 22 adapted to engage the work piece 22 to the drive shaft 13. Finally, the method also includes the further steps of engaging the work element 101 when the drive shaft 13 is in the first operative position and actuating the hand tool 1 such that the drive shaft 13 is disposed in the second operative position to impart work to the work element 101. What is also contemplated is the additional step to this or the above disclosed method of engaging the work element 101 when the drive shaft 13 is in the third operative position and actuating the housing 3 when the drive shaft 13 is disposed this third operative position as shown on FIG. 24 to impart work to the work piece.

Figure 35:
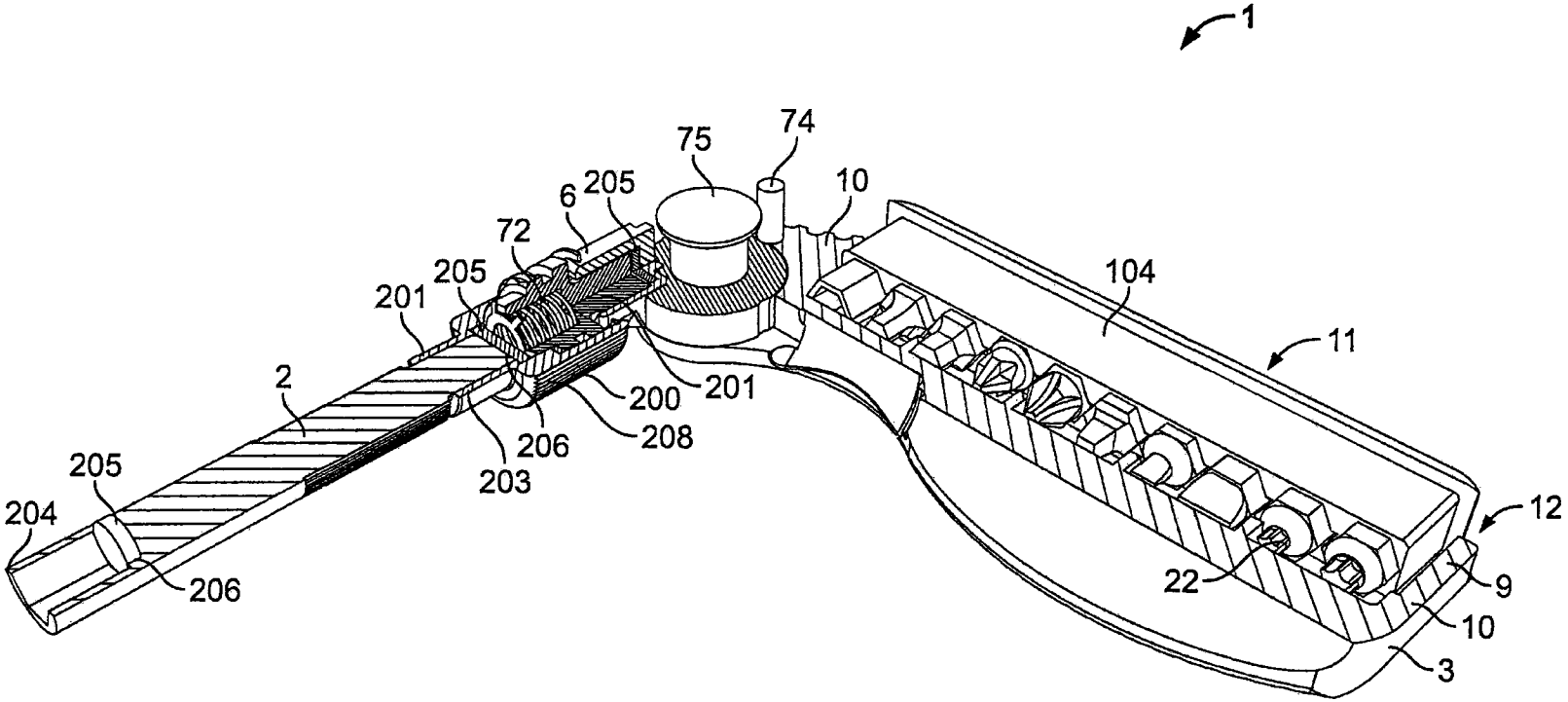
FIG. 35 is a partial perspective cross-sectional view of the hand tool equipped with a drive assembly having a coupler according to another possible embodiment of the present disclosure.
Figure 36:
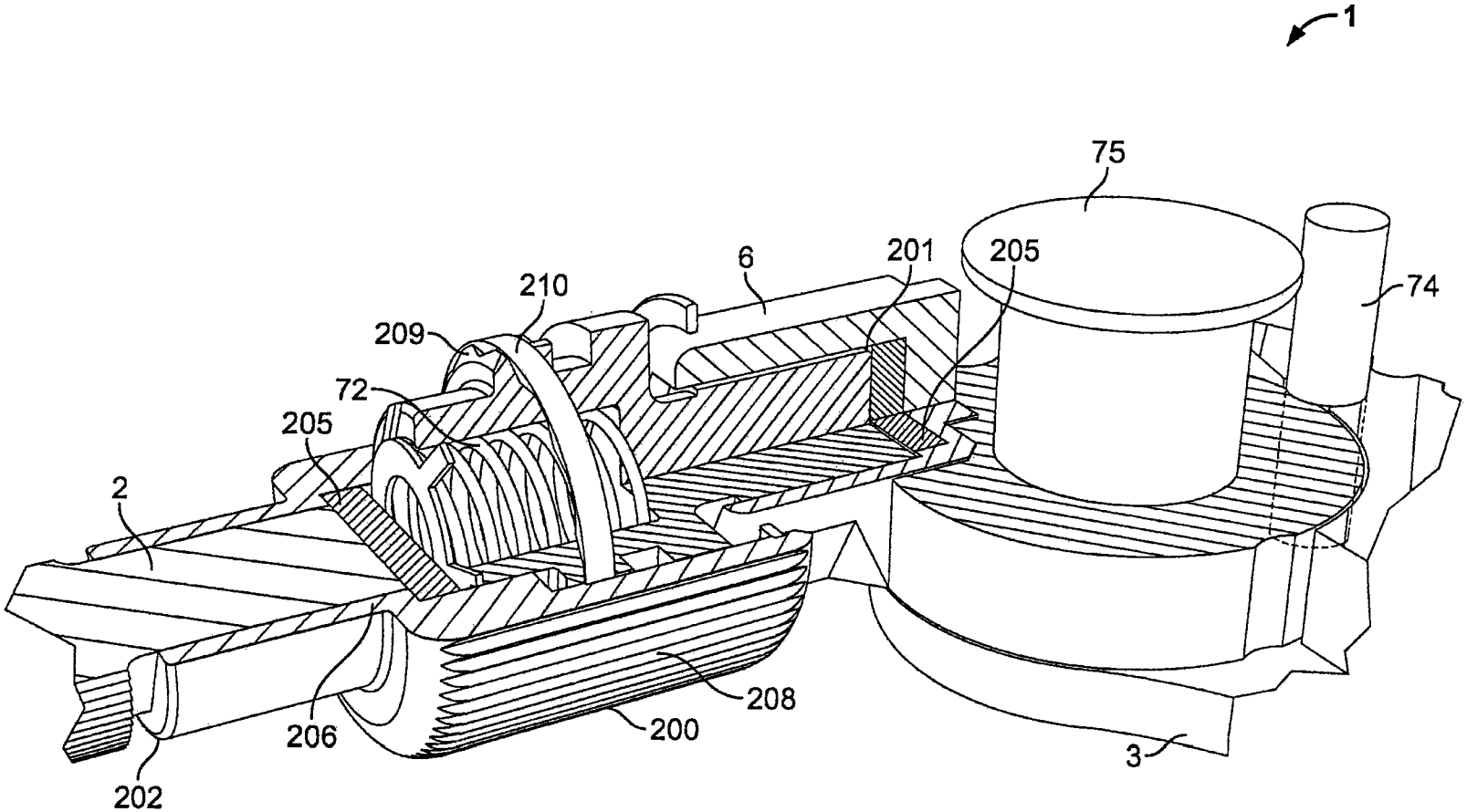
FIG. 36 is a partial cut-away view of the hand tool of FIG. 35 in the semi-opened configuration and shown in shadow in the opened configuration according to a possible embodiment of the present disclosure.

FIG. 35 shows a partial perspective cross-sectional view of the hand tool 1 equipped with a coupler 200 according to another possible embodiment of the present disclosure. The hand tool 1 includes a housing 3 with a first end 6, a drive assembly 2 connected to the first end 6, a coupler 200 and a drive shaft 13, the coupler 200 including a proximate element 201, a remote element 202, and a biasing mechanism 72, where the proximate element 201 is movably connected to the remote element 202 and the biasing mechanism 72 is disposed between the proximate element 201 and the remote element 202.

In an alternate embodiment, the housing 3 includes a storage element compartment 9 defined by a plurality of walls 10 contiguous with the housing 3 to define a cavity 11 and an opening 12. The drive shaft 13 also includes a proximate end 203 and a remote end 204. In one embodiment shown as FIG. 35, the first end 6, the remote element 202, and the remote end 204 are each equipped with second configurations. The work pieces 22 stored within a protector 104 having a plurality of such work pieces 22 can be stored inside the housing 3. These work pieces 22 can be used on the first end 6, the remote element 202, or the remote end 204 if the body of the work piece 22 designed with the shape of a first configuration. The use of a coupler 200 permits the drive assembly 2 to move in either a freewheeling mode as shown on FIG. 39 in a first operative position or to be moved to a second operative position as shown on FIG. 40.

Figure 38:
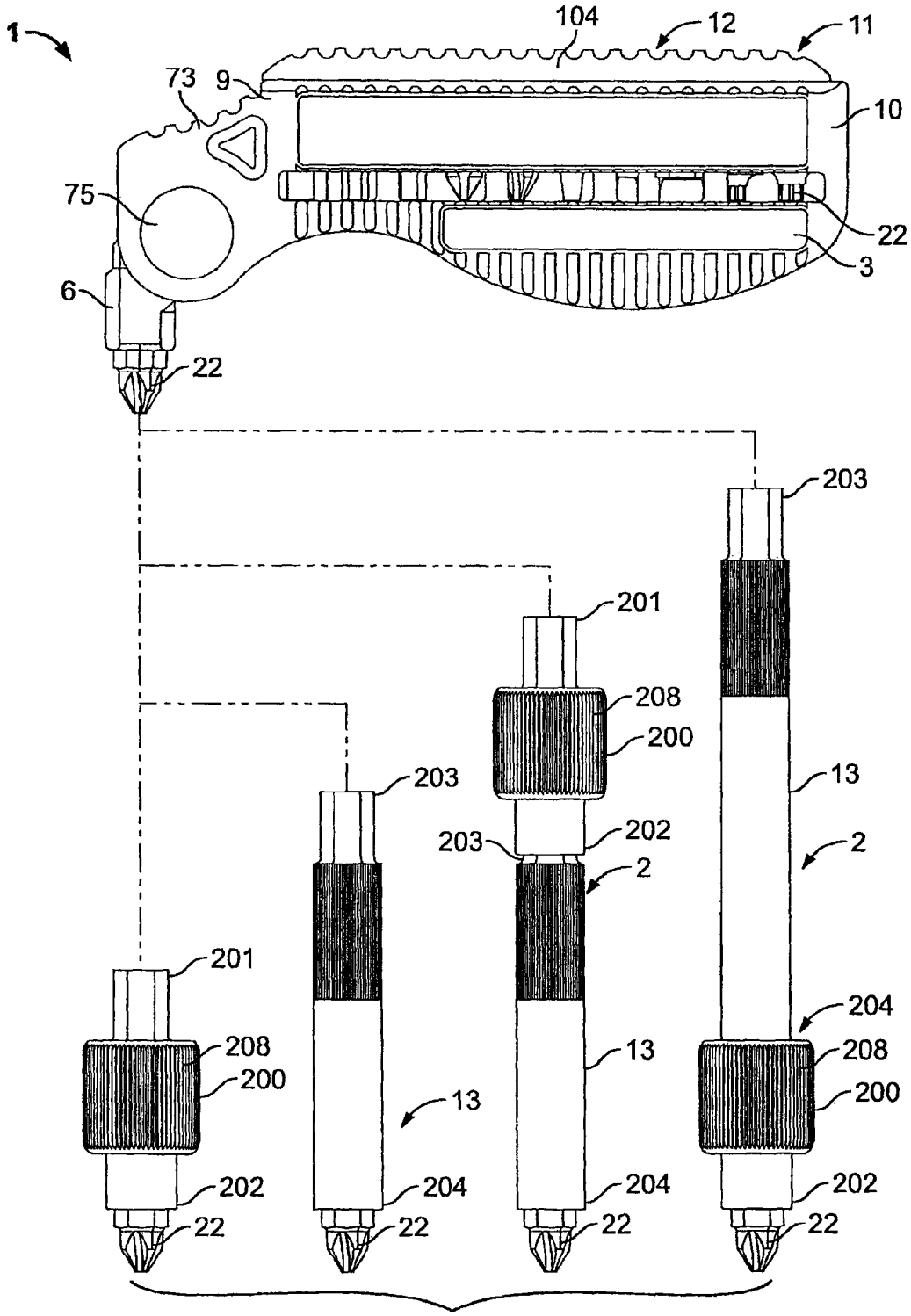
FIG. 38 is a side elevation view of the hand tool with a coupler as shown in FIG. 35 with an alternate orientation of the different elements of the drive assembly according to other possible embodiments.
Figure 39:
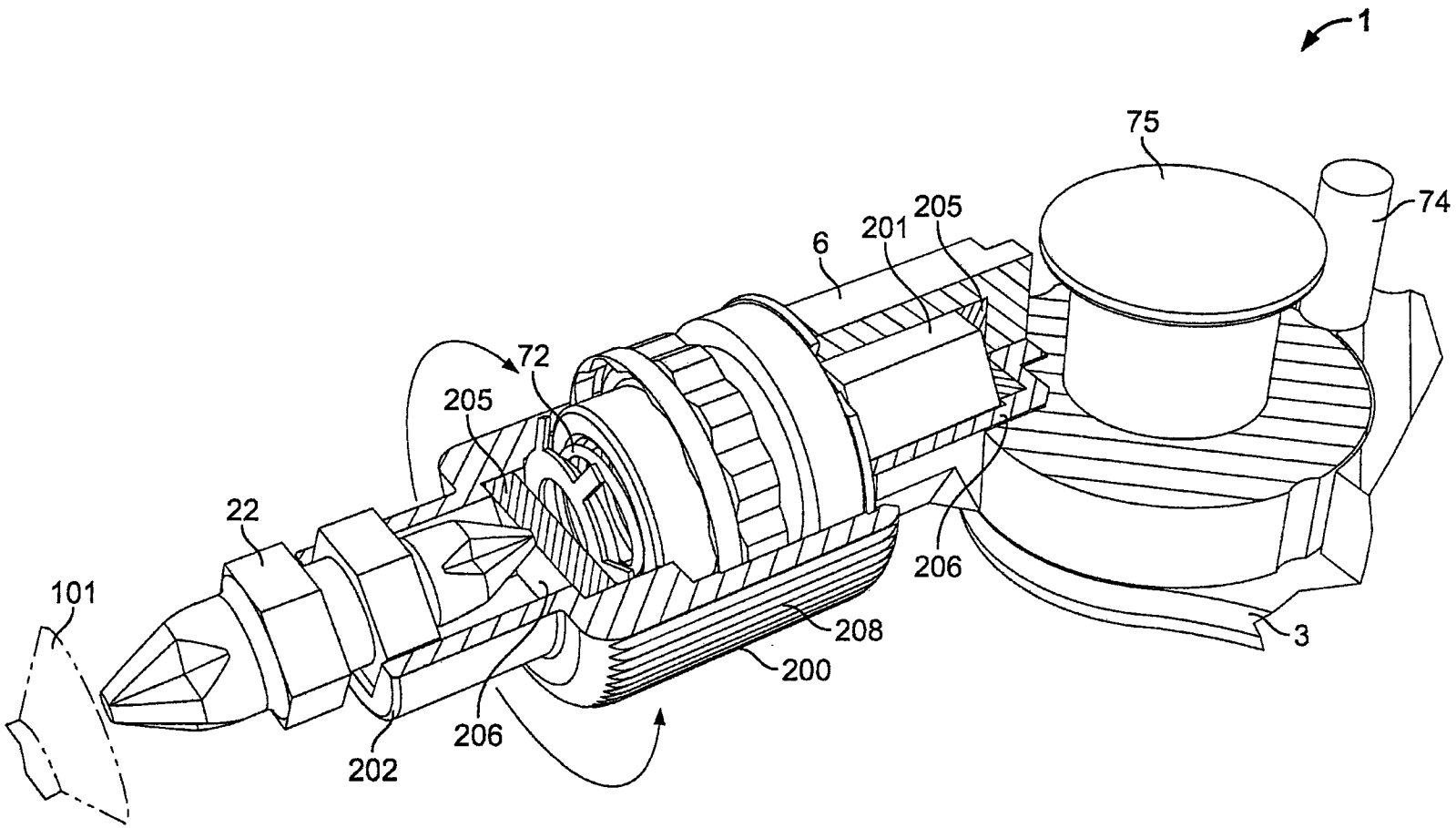
FIG. 39 is a is a partial cross-sectional view of the hand tool of FIG. 35 in a first operative position without drive shaft according to a possible embodiment of the present disclosure.
Figure 40:
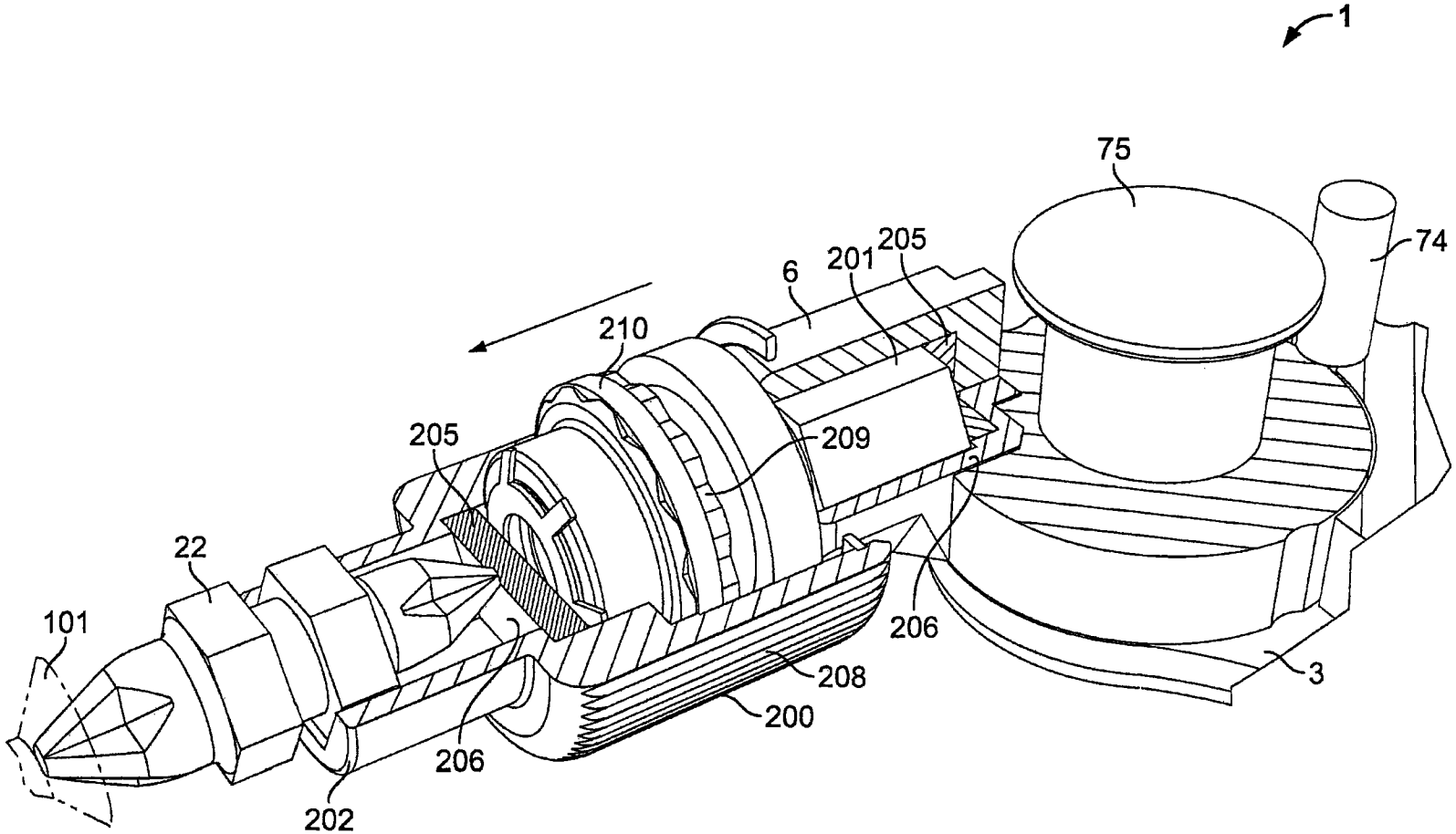
FIG. 40 is a is a partial cross-sectional view of the hand tool of FIG. 35 in a second operative position without drive shaft according to a possible embodiment of the present disclosure.

FIG. 38 shows a couple of the numerous assembly configurations associated with using a first and second configurations of complimentary geometries of on different elements of the hand tool 1. It is within the present disclosure to use different types of connectors with other geometries in different orientations or configurations to allow for other arrangements of extension pieces and the like. The first configuration can also be made of a material with magnetic properties and the second configurations may include a magnet to act magnetically on the material of the first configuration. FIG. 35 illustrates different magnets 205 placed in the different second configurations 6, 202, 204. The first configurations 201, 203 and the second configurations 6, 202, 204 may form a guided interlock mechanism where the magnet 205 is located at a bottom end 206 of the second configurations 6, 202, 204 to guide the first configurations 201, 203 and the work piece 22.

Figure 37:
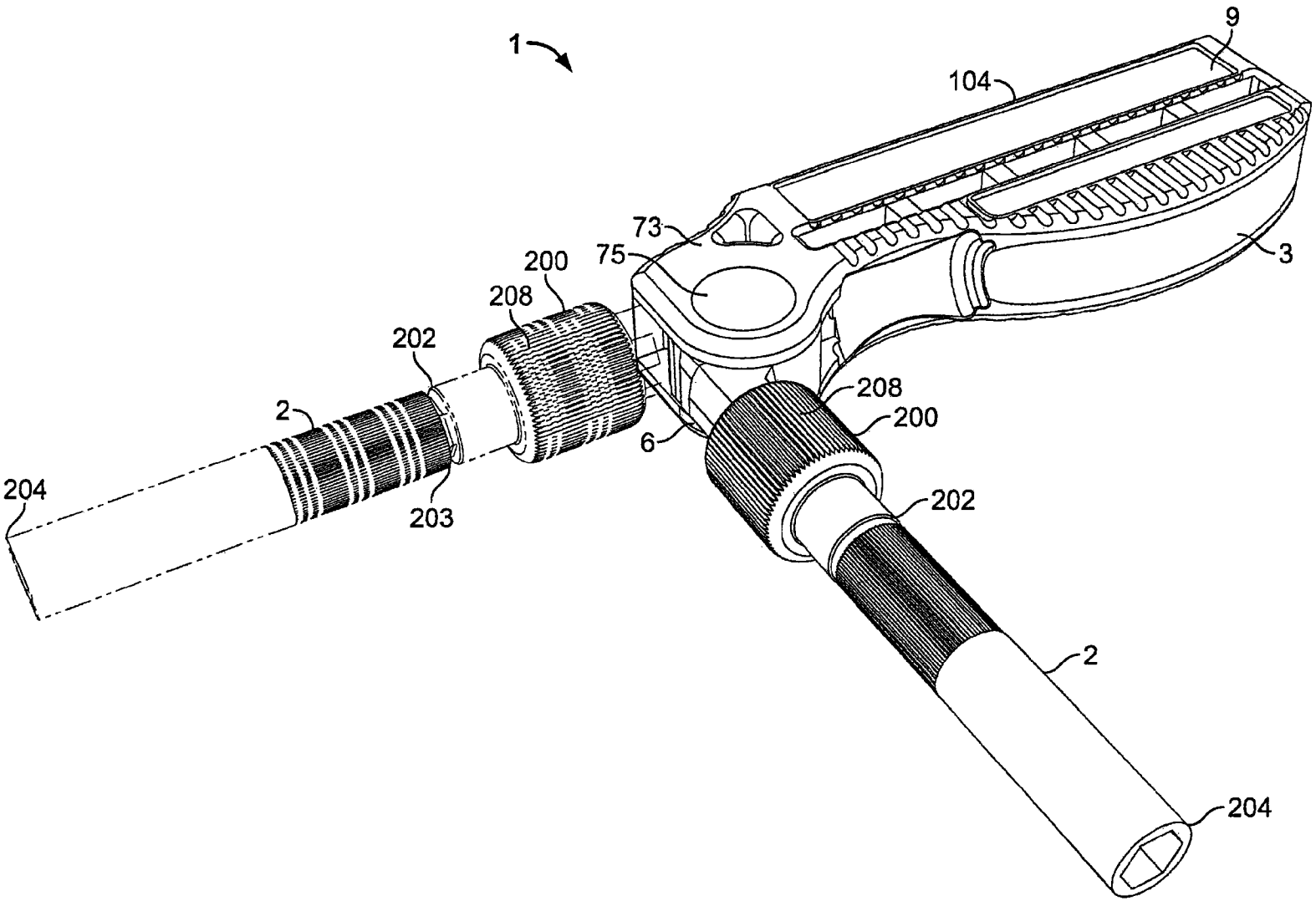
FIG. 37 is a perspective view of the hand tool of FIG. 35 with a hub in a first orientation and in a second orientation as shown by shadow lines according to a possible embodiment of the present disclosure.

In one embodiment, the remote end 204 is a receptacle for a work piece 22. What is also contemplated is a hand tool 1 where the first end 6 of the housing 3 includes a hub 75 that facilitates movable or pivotal connection for the drive assembly 2. FIG. 35 shows a hub 75 made in one embodiment of metal, which rotates around a center pivot where one fragment of the hub 75 includes the second configuration. A lock mechanism 73 disposed on the first end 6 at a different position than the second configuration of the housing 3 includes a movable lock element 74 wherein the lock element 74 engages the hub 75 to block the pivotal connection in a desired orientation with respect to the housing where receptacles 76 are located. FIG. 37 illustrates a first position of the hub 75 at a 90° angle from the housing 3 in regular lines while a second position of the hub 75 at a 180° angle from the housing 3 is shown in shadow lines. The use of any acceptable working angle in association with any adaptor on the drive assembly 2 permits a better operation of the work element 101. FIG. 35 shows a coupler 200 where the biasing mechanism 72 is a spring inserted in a cavity formed in the coupler 200.

Ridges 208 on the external surface of the coupler 200 constitute a rough external surface for rotating the remote element 202 with respect to the proximate element 201 and rotating the drive shaft 2. The remote end 204 of the driving shaft 2 is movable with respect to the first end 6 of the housing 3 when the drive shaft 2 is disposed in a first operative position. The proximate element 201 includes a first coupling surface 209 and the remote element 202 includes a second coupling surface 210 where the first coupling surface 209 engages the second coupling surface 210 when the drive shaft 2 is disposed in a second operative position. In one contemplated embodiment, the drive assembly 2 moves from the first operative position to the second operative position when the drive shaft 2 is pressed against a work element 101. What is also contemplated is the use of an alternate device where force is required to move the drive assembly 2 from the first operative position to the second operative position by pulling on the drive shaft 2.

In another embodiment, a hand tool including a housing 3 with a first end 6, a hub 75 is pivotally connected to the first end 6 of the housing 3 and includes circumferentially spaced receptacles 76, the lock element 74 is disposed contiguous to the hub 75, the drive assembly 2 is movably connected to the hub 75, a coupler 200 and a drive shaft 13 are connected to the coupler 200, and the housing 3 adjacent to the lock element 74 is movable to accommodate the pivoting of the hub 75 such that the lock element 74 engages a receptacle 76 when the elements are aligned in registration. In one embodiment, the housing 3 is made of a deformable polymer and the lock element 74 is movable with respect to the hub 75 as a result of forces created in the housing 3 when the hub 75 is pivoted between the spaced receptacles 76. What is contemplated is any use of deformable material in conjunction with assembly tolerance in association with friction-based or internal deformation-based displacement or rotation of items.

Figure 41:
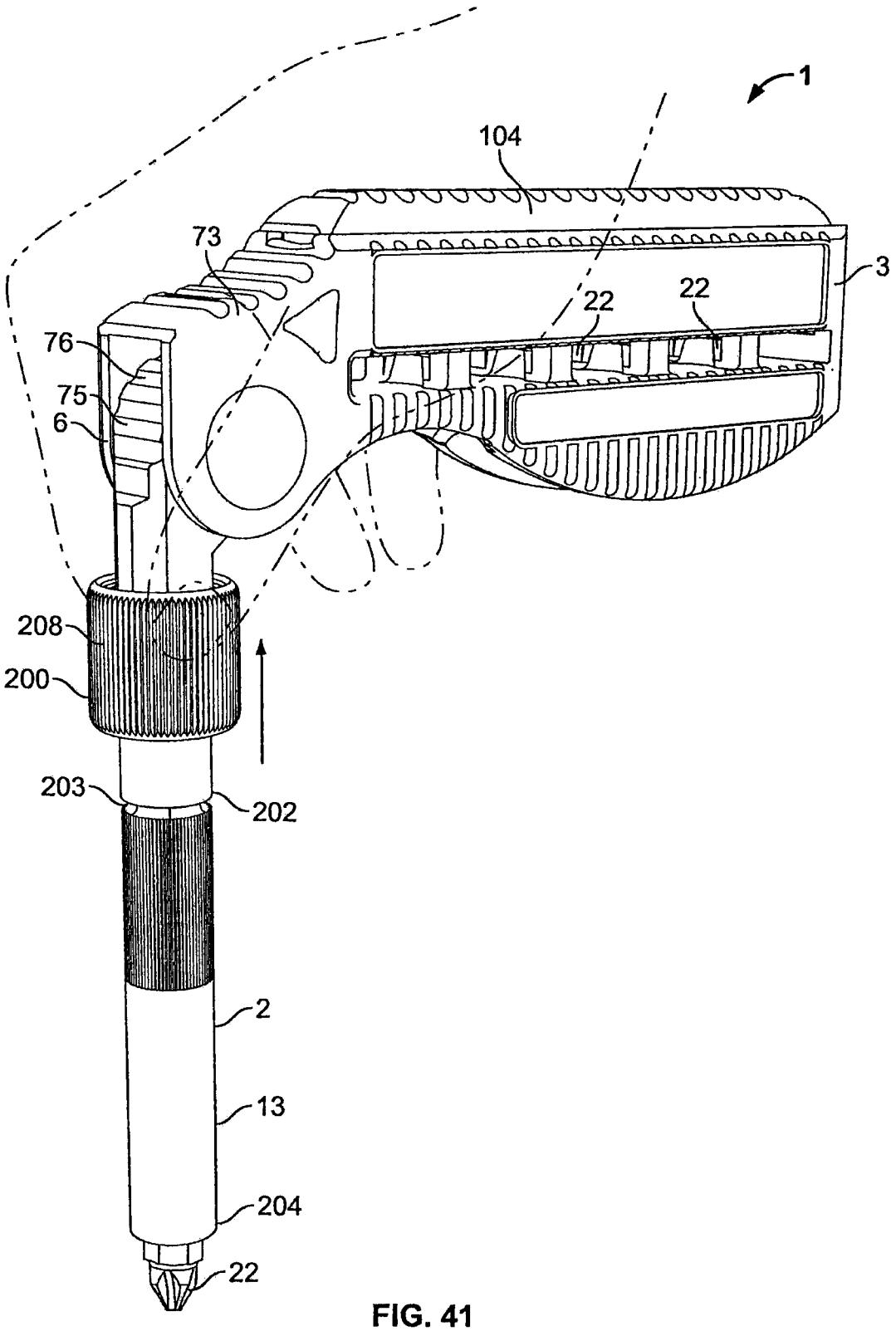
FIG. 41 is a perspective view of the band tool of FIG. 35 as held in the hand of an operator.

FIG. 41 is a perspective view of the hand tool of FIG. 35 as held by an operator used in conjunction with the method described hereafter. The method comprises the successive steps for removing the strain placed on a work element 101 using a tensile-strain activated tool 1 held in a hand 212 between the palm, index finger, and thumb as shown in FIG. 41. The method includes grasping in the palm a tensile-strain activated tool 1 with a housing 3, a drive assembly 2, a drive shaft 13, and a coupler 200 and then grasping the coupler 200 with the index finger and the thumb and imparting a compression force between the coupler 200 and the housing 3 to overcome a biasing force in the coupler 200 to move the drive assembly 2 from a first operative position to a second operative position. Finally, the method comprises the step of holding the compression force and rotating the housing 3 to impart a rotation force to the work element 101.

In another method where work is imparted to work element 101, comprising the steps of providing a hand tool 1 having a housing 3 and a drive shaft 13 rotatable within the housing 3 in a first position and held by and rotatable with the housing 3 in a second position, the shaft 13 having a drive assembly 2 at an end 6 extending from the housing 3 and the drive assembly 2 having a work piece 22 for imparting work to the work element 101. In a second step, the method relates to grasping the hand tool housing 3 within a hand between palm and fingers, and moving the drive shaft 13 to the first position while the housing is held in the palm with a force inferior than what is needed to move the shaft from the first position to the second position, manipulating the work piece 22 with at least one finger to impart work to the work element 101 through the work piece 22 while the housing rests in the palm, moving the drive shaft 13 to the second position once a greater force is needed to impart work on the work element 101 and imparting work to the work element 101 through the work piece 22 by moving the palm and fingers in such a way as to forcibly move the housing 3.

It is understood by one of ordinary skill in the art that these steps correspond to the general steps to be taken to practice the methods of this disclosure. Other auxiliary steps may be taken but do not affect the validity and completeness of the disclosure of this general method. Persons of ordinary skill in the art appreciate that although the teachings of the disclosure have been illustrated in connection with certain embodiments and methods, there is no intent to limit the invention to such embodiments and methods. On the contrary, the intention of this application is to cover all modifications and embodiments falling fairly within the scope of the teachings of the disclosure.

What is claimed is:

1. A tool comprising:

(a) a housing with a first end including a hub that pivotally connects the first end to the housing;

(b) a lock mechanism disposed on the housing with a movable lock element wherein the lock element engages the hub to block the pivotal connection in a desired orientation with respect to the housing;

(c) a drive assembly removably connected to the first end comprising a coupler and a drive shaft, the coupler including a proximate element, a remote element, and a biasing mechanism being disposed between the proximate element and the remote element and wherein the drive shaft is movably disposed between a first operable position and a second operable position; and (d) wherein the proximate element includes a first coupling surface disposed on an outer surface of the proximate element and the remote element includes a second coupling surface disposed on an inner surface of the remote element, wherein the drive shaft is normally disposed in the first operative position in which the first coupling surface does not engage the second coupling surface and wherein the first coupling surface engages the second coupling surface when the drive shaft is disposed in the second operative position.

2. The tool of claim 1, wherein the housing further comprises a storage element compartment defined by a plurality of walls contiguous with the housing to define a cavity and an opening therefor.

3. The tool of claim 1, wherein the drive shaft further comprises a proximate end and a remote end and wherein the first end, the remote element, and the remote end are a first configuration, and the proximate element, and the proximate end are a second configuration complementary adapted to interlock to the first configuration.

4. The tool of claim 3, wherein the first configuration is made of a material with magnetic properties and the second configurations include a magnet.

5. The tool of claim 4, wherein the first configuration and the second configuration form a guided interlock mechanism with the magnet located at a bottom end of the second configuration to guide the first configuration thereinto.

6. The tool of claim 3, wherein the remote end is a receptacle for a work piece.

7. The tool of claim 3, wherein the remote end of the driving shaft is movable with respect to the first end of the housing when the drive shaft is disposed in a first operative position.

8. The tool of claim 1, wherein the first end of the housing and the hub facilitate pivotal connection for the drive assembly.

9. The tool of claim 1, wherein the hub includes a plurality of circumferentially spaced receptacles.

10. The tool of claim 9, wherein the lock element includes a protrusion configured to engage at least one of the receptacles.

11. The tool of claim 1, wherein the hub includes a plurality of circumferentially spaced projections.

12. The tool of claim 11, wherein the lock element includes a recess configured to engage at least one of the projections.

13. The tool of claim 12, wherein the coupler further includes a rough external surface for rotating the remote element with regards to the proximate element and rotate the drive shaft.

14. The tool of claim 1, wherein the biasing mechanism is a spring located in a cavity formed in the coupler.

15. The tool of claim 1, wherein the housing further comprises a holster for receiving the drive shaft.

16. The tool of claim 1, wherein the drive assembly moves from the first operative position to the second operative position when the drive shaft is pressed against a work element.

17. The tool of claim 1, further comprising (a) the hub having circumferentially spaced receptacles;

(b) the lock element disposed contiguous to the hub; and (c) the drive assembly movably connected to the hub, (d) wherein the housing adjacent to the lock element is movable to accommodate the pivoting of the hub such that the lock element engages a receptacle when the elements are aligned in registration.

18. The tool of claim 17, wherein the housing is made of a deformable polymer and the lock element is movable with respect to the hub as a result of forces created in the housing when the hub is pivoted between the spaced receptacles.

19. A method of imparting work to a work element, comprising the steps of:

(a) providing a tool having a housing with a first end including a hub that pivotally connects the first end to the housing; a lock mechanism disposed on the housing with a movable lock element wherein the lock element engages the hub to block the pivotal connection in a desired orientation with respect to the housing; a drive assembly removably connected to the first end comprising a coupler and a drive shaft, the coupler including a proximate element, a remote element, and a biasing mechanism being disposed between the proximate element and the remote element; the proximate element includes a first coupling surface disposed on an outer surface thereof and the remote element includes a second coupling surface disposed on an inner surface thereof, and wherein the drive shaft is movably disposed between a first operative position in which the first coupling surface does not engage the second coupling surface and a second operative position in which the first coupling surface engages the second coupling surface, (b) manipulating the work piece with at least one finger to impart work to the work element through the work piece while the housing rests in the palm and the drive shaft is disposed in said first operative position, (c) moving the shaft to the second position once a greater force is needed to impart work on the work element, and (d) imparting work to the work element through the work piece by moving the palm and fingers to forcibly move the housing.

* * * * *